US008272668B2

(12) United States Patent
Keehan et al.

(10) Patent No.: US 8,272,668 B2
(45) Date of Patent: Sep. 25, 2012

(54) COMPOSITE WALL STRUCTURE, TANK TRAILER FORMED THEREFROM AND METHOD OF MANUFACTURING SAME

(75) Inventors: Donald J. Keehan, Avon Lake, OH (US); John M. Manos, Highland Heights, OH (US)

(73) Assignee: ASCUS Technologies, Ltd., Cleveland, OH (US)

( * ) Notice: Subject to any disclaimer, the term of this patent is extended or adjusted under 35 U.S.C. 154(b) by 0 days.

(21) Appl. No.: 13/229,435

(22) Filed: Sep. 9, 2011

(65) Prior Publication Data

US 2011/0315681 A1 Dec. 29, 2011

Related U.S. Application Data

(62) Division of application No. 11/916,652, filed as application No. PCT/US2005/045397 on Dec. 14, 2005, now Pat. No. 8,016,322.

(60) Provisional application No. 60/635,933, filed on Dec. 14, 2004.

(51) Int. Cl.
*B60P 3/22* (2006.01)
*B29C 45/14* (2006.01)

(52) U.S. Cl. ..... 280/837; 280/839; 264/516; 29/452; 29/446

(58) Field of Classification Search ..... 280/839, 280/837; 264/516
See application file for complete search history.

(56) References Cited

U.S. PATENT DOCUMENTS

| | | | | |
|---|---|---|---|---|
| 2,744,043 | A * | 5/1956 | Ramberg | 156/155 |
| 3,158,383 | A * | 11/1964 | Anderson et al. | 280/837 |
| 3,207,352 | A | 9/1965 | Reinhart, Jr. | |
| 3,851,786 | A | 12/1974 | Kaempen | |
| 3,969,812 | A * | 7/1976 | Beck | 29/421.1 |
| 5,346,233 | A * | 9/1994 | Moser | 280/149.2 |
| 6,991,124 | B1 | 1/2006 | Palley et al. | |

OTHER PUBLICATIONS

International Search Report from International Application No. PCT/US2005/045397, filed Dec. 14, 2005.

* cited by examiner

*Primary Examiner* — Tashiana Adams
*Assistant Examiner* — Jacob Knutson
(74) *Attorney, Agent, or Firm* — Fay Sharpe LLP

(57) ABSTRACT

A composite wall structure formed from a plurality of layers. The composite wall structure can be used to form a composite storage tank having a tank cavity and a longitudinal axis. A composite tank trailer can be formed using the composite tank, a platform structure and a suspension and wheel assembly.

7 Claims, 21 Drawing Sheets

COMPOSITE WALL STRUCTURE, TANK TRAILER FORMED THEREFROM AND METHOD OF MANUFACTURING SAME

This application is a divisional application of U.S. patent application Ser. No. 11/916,652, filed Dec. 5, 2007 now U.S. Pat. No. 8,016,322, which is the National Stage of International Application No. PCT/US2005/045397, filed Dec. 14, 2005, which claims the benefit of U.S. Provisional Application No. 60/635,933, filed Dec. 14, 2004.

BACKGROUND

The present novel concept broadly relates to the art of cargo tanks and, more particularly, to a composite wall structure and a cargo tank trailer construction as well as a method of manufacturing the same.

Portable cargo tanks are typically designed and constructed to be suitable for transport using commonly available equipment and/or for movement within a predetermined space or envelope. For example, cargo tank trailers are constrained by various federal regulations regarding the size (e.g., length, width, height) and laden weight of the trailer. In some situations, the size limitations will dictate the quantity of product that can be transported. This is particularly true of bulky or low density products. In such situations, the weight of the fully loaded trailer often does not approach the weight constraints established by the federal regulations.

In many other situations, however, higher density payloads are being transported and the federal limitations on the laden weight of the trailer are determinative of the quantity of product that can be transported. That is, the combination of the empty (or tare) weight of the cargo tank trailer plus the weight of the quantity of product to be transported must be less than the maximum allowable laden weight established by the federal regulations. Since the empty weight of the cargo tank trailer is fixed, the amount of cargo that can be loaded will be limited to the difference between the maximum allowable vehicle weight and the tare weight of the trailer. As such, it is desirable to minimize the unladen or tare weight of the tank trailer to thereby maximize the payload that can be transported.

Attempts have been made to develop tank trailers having a reduced tare weight by using fiberglass reinforced composite material for the construction of the tank. While some reduction in the empty weight of tanks themselves have been possible using such constructions, other additional features and compartments have been included to form the tank trailer, and these additional features and components can significantly offset this weight savings. More specifically, known cargo tank trailers that are formed from a composite wall structure are formed from fiberglass material that is wound radially (also referred to as hoop windings) to form the body of the tank. Used alone, however, windings of this nature are generally recognized as being unable to withstand all of the load conditions to which the tank trailer will be subjected. As such, additional structural components are utilized to support the composite tank and carry the loads that known composite tanks are incapable of withstanding. Such additional structural components often take the form of a metal framework, which can include metal beams or other members that extend along the length of the trailer. The added weight of these components normally significantly offset any weight savings obtained from the use of the composite tank.

It is desirable to develop a composite wall structure, cargo tank trailer and method of manufacture that minimize or overcome the foregoing problems and disadvantages.

BRIEF DESCRIPTION

A composite wall structure in accordance with the present novel concept is provided for use in forming an associated storage tank. The composite wall structure includes a first layer including a first plurality of lengths of filament material having a substantially high modulus and a substantially high tensile strength. A second layer is formed outwardly of the first layer and includes a material having a substantially low density. A third layer is formed outwardly of the second layer and includes a second plurality of lengths of filament material having a substantially high modulus and a substantially high tensile strength. A fourth layer is formed outwardly of the third layer and includes a substantially low density and an energy absorbing property. A fifth layer is formed outwardly of the fourth layer and includes a third plurality of lengths of filament material having a relatively high modulus and a relatively high tensile strength.

A composite tank trailer in accordance with the present novel concept is provided and includes a wall structure including a tank wall that defines a tank cavity and a longitudinal axis. The tank wall has a wall curvature. The wall structure is formed from a plurality of layers with at least one of the layers including a length of filament material and an adhesive material. A support member is disposed along the wall structure and includes a base wall positioned toward the wall structure and a flange extending from the base wall generally opposite the wall structure. The support member has a curvature substantially similar to the wall curvature. An attachment layer is formed outwardly of the wall structure and at least partially covers the support member to secure the same to the wall structure. The attachment layer includes a length of filament material and an adhesive material. A platform structure is secured along the support member, and a suspension and wheel assembly is secured to the platform structure.

A composite tank trailer in accordance with the present novel concept is provided and includes a wall structure including a side wall portion and opposing end wall portions defining a tank cavity and a longitudinal axis. The side wall portion has a wall curvature and the wall structure is formed from a plurality of layers with at least one of the layers including a length of filament material and an adhesive material. A support member is disposed along the side wall and includes a base wall positioned toward the wall structure and a flange extending from the base wall generally opposite the wall structure. The support member has a curvature similar to the wall curvature. An attachment layer is formed outwardly of the wall structure and at least partially covers the support member to secure the support member to the wall structure. The attachment layer includes a length of filament material and an adhesive material. A platform structure is secured along the support member, and a suspension and wheel assembly is secured to the platform structure.

A composite tank trailer in accordance with the present novel concept is provided and includes a liner having a side wall portion and opposing end wall portions at least partially defining a tank cavity and a longitudinal axis. A wall structure is formed outwardly of the liner and is formed from a plurality of layers with a first layer including a length of filament material and an adhesive material, a second layer including a substantially low-density material, and a third layer including a length of filament material and an adhesive material. A plurality of support members is disposed longitudinally along the wall structure. The support members include a base wall and at least one flange extending from the base wall. An attachment layer is formed along the wall structure and at least partially covers the plurality of support members. The attachment layer is formed from a length of filament material and an adhesive material. Two or more platform structures are secured between at least two different ones of the support members. A pivot pin is supported on one of the two platform structures, and a suspension and wheel assembly is supported on another of the two or more platform structures.

A composite tank trailer in accordance with the present novel concept is provided and includes a tank body including a liner and a wall structure formed outwardly of the liner. The liner includes a side wall and opposing end walls that together define a tank cavity having a longitudinally extending axis. The wall structure is formed from a plurality of layers including a first layer formed outwardly of the liner, a second layer formed outwardly of the first layer and a third layer formed outwardly of the second layer. At least one of the first and third layers includes a length of filament material wound in at least one helical pattern and at least one hoop pattern. A plurality of support members is spaced longitudinally along the tank body and at least two groups of support members. The support members include a base wall oriented toward the tank body and a pair of spaced-apart flanges extending from the base wall generally opposite the tank body and forming a channel therebetween. An attachment layer is formed outwardly of the wall structure and at least partially covers each of the support members. The attachment layer includes a length of filament material wound in a hoop pattern around the tank body forming a plurality of hoops with a portion of the plurality of hoops extending along the channel of each of the support members. A plurality of platform structures is spaced longitudinally along the tank body. Each of the platform structures is secured to a different group of the at least two groups of support members. Each of the platform structures includes a frame and at least two cradles attached to the frame with each of the cradles being attached to a different on of the support members. A pivot pin is supported on one of the plurality of platform structures, and a suspension and wheel assembly is supported on another of the plurality of platform structures.

A method of forming a composite tank trailer in accordance with the present novel concept is provided and includes forming a liner having a side wall portion and opposing end wall portions at least partially defining a tank cavity. The method also includes forming a wall structure outwardly of the liner. The wall structure including a plurality of layers with at least one of the plurality of layers including a length of filament material and an adhesive material. The method further includes providing a support member and positioning the support member along the wall structure. The method also includes forming an attachment layer outwardly of the wall structure and at least partially covering the support member to secure the support member along the wall structure. Further steps include providing a platform structure and securing the platform structure to the support member, as well as providing a suspension and wheel assembly and securing the assembly on the platform structure.

A method of forming a composite tank trailer in accordance with the present novel concept is provided and includes forming a wall structure having a side wall portion and opposing end wall portions defining a tank cavity and a longitudinal axis. The wall structure includes a plurality of layers with at least one layer including a length of filament material and an adhesive material. The method also includes providing a plurality of support members and positioning the support members spaced longitudinally along the wall structure. The method further includes forming an attachment layer outwardly of the wall structure and at least partially covering each of the support members to secure the support members along the wall structure. The method also includes providing a plurality of platform structures and securing each of the platform structures to at least a different one of the support members. The method further includes providing a pivot pin and a suspension and wheel assembly and securing each of the pivot pin and suspension and wheel assembly to a different one of the platform structures.

A composite wall structure in accordance with the present novel concept is provided for forming an associated cargo container having an associated cargo chamber. The composite wall structure includes a first layer including a first material having a substantially high-strength tensile property and a second layer including a second material having a substantially low density. The composite wall structure also includes a third layer including a third material having a substantially high-strength tensile property and a fourth layer including a fourth material having a substantially low density. A fifth layer includes a fifth material having a relatively high-tensile strength property.

A method of manufacturing a storage tank having a composite wall construction in accordance with the present novel concept is provided and includes forming a liner having a side wall portion and opposing end wall portions that at least partially define a tank cavity and a tank axis. The method also includes providing a plurality of end members and securing one of the end members along each of the opposing wall portions. The method further includes supporting the liner by the end members for rotatable movement substantially about the axis and forming a plurality of layers outwardly of the liner. The method also includes applying a coating layer outwardly of the plurality of wall layers.

A method of manufacturing a composite storage tank having a multi-layer wall construction, in accordance with the present novel concept, is provided and includes forming a first layer at least partially defining an inside surface of the tank. The first layer includes a first material having one of a substantially non-reactive property and a substantially low surface energy property. The method also includes forming a second layer outwardly of the first layer. The second layer includes a second material having a tensile strength of 400 ksi or greater. The method further includes forming a third layer outwardly of the second layer with the third layer including a third material having a substantially low density. The method also includes forming a fourth layer outwardly of the third layer with the fourth layer including a fourth material having a tensile strength of 400 ksi or greater. The method also includes forming a fifth layer outwardly of the fourth layer with the fifth layer including a fifth material having a substantially low density. The method also includes forming a sixth layer outwardly of the fifth material and applying a coating layer outwardly of the sixth layer. The sixth layer including a sixth material having a tensile strength of 250 ksi or greater.

DETAILED DESCRIPTION

Figure 1:
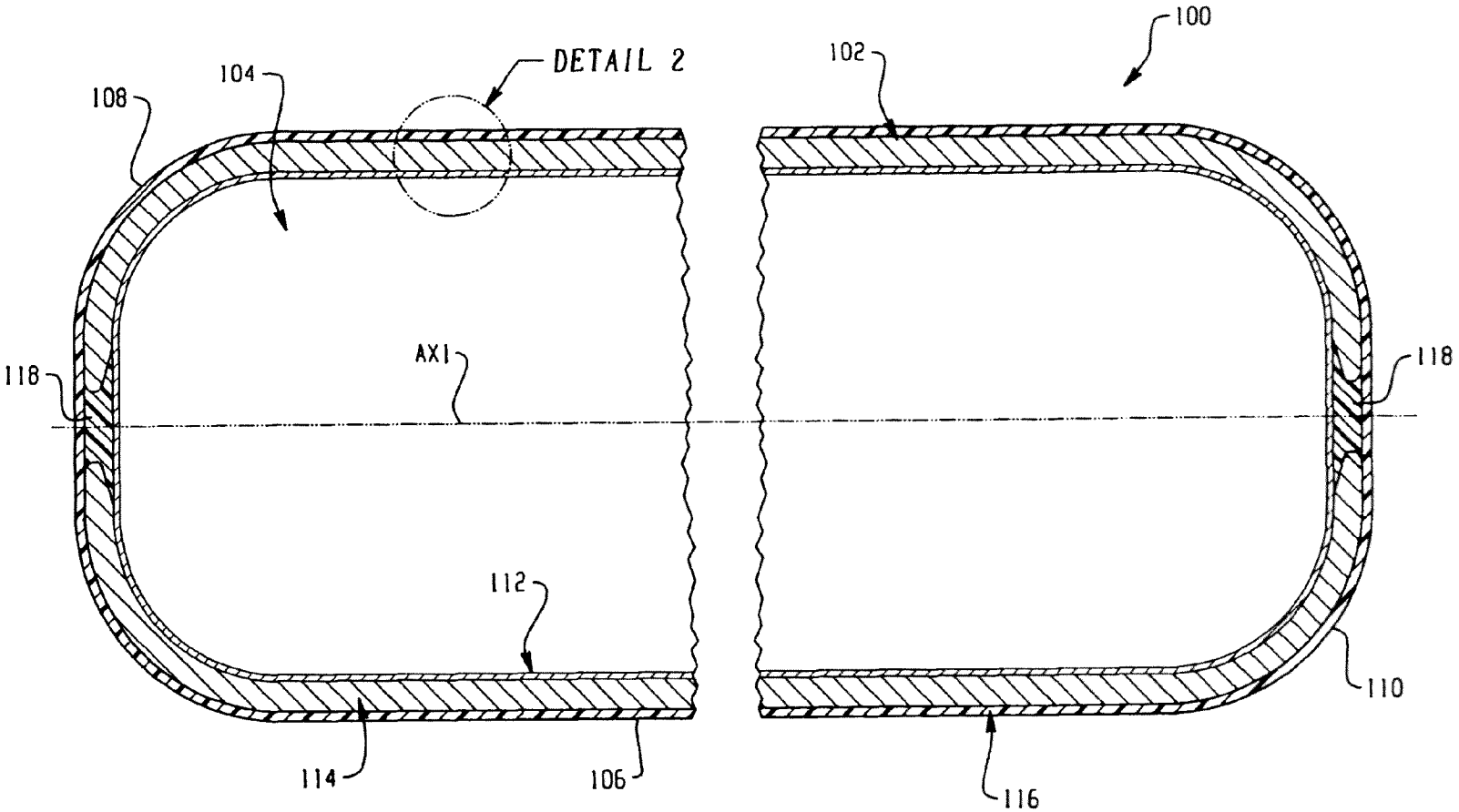
FIG. 1 is a cross-sectional view of one exemplary embodiment of a storage tank having a composite tank wall in accordance with the present novel concept.

Turning now to the drawings, wherein the showings are for the purpose of illustrating exemplary embodiments of the present novel concept only and not for the purpose of limiting the same, FIG. 1 shows a composite storage tank 100 in accordance with the present novel concept. Tank 100 includes a composite tank wall 102 defining a tank cavity 104 and an axis AX1. In the exemplary embodiment shown in FIG. 1, tank wall 102 generally includes a central portion 106 and opposing curved ends 108 and 110. The curved ends are shown as substantially dome shaped with the central portion shown as being substantially cylindrical. However, it will be appreciated that a composite storage tank in accordance with the present novel concept can be of any suitable size, shape and/or configuration.

Generally, composite tank wall 102 is formed from a plurality of stratified layers that are grouped into three different composite layers for convenience and ease of reading. The composite layers include an inner composite layer or liner 112, a structural composite layer or wall structure 114 and an outer composite layer 116. Optional end members 118 are included along curved ends 108 and 110, and can be used in forming a composite storage tank, such as tank 100, as will be discussed in detail hereinafter. It should also be understood that the various walls, layers, materials, coatings and other similar features described herein may be shown in the drawing figures as having an increased thickness dimension for clarity and ease of illustration. As such, the drawing figures are not intended to be representative of the scale or thickness of any one layer or group of layers.

Figure 2:
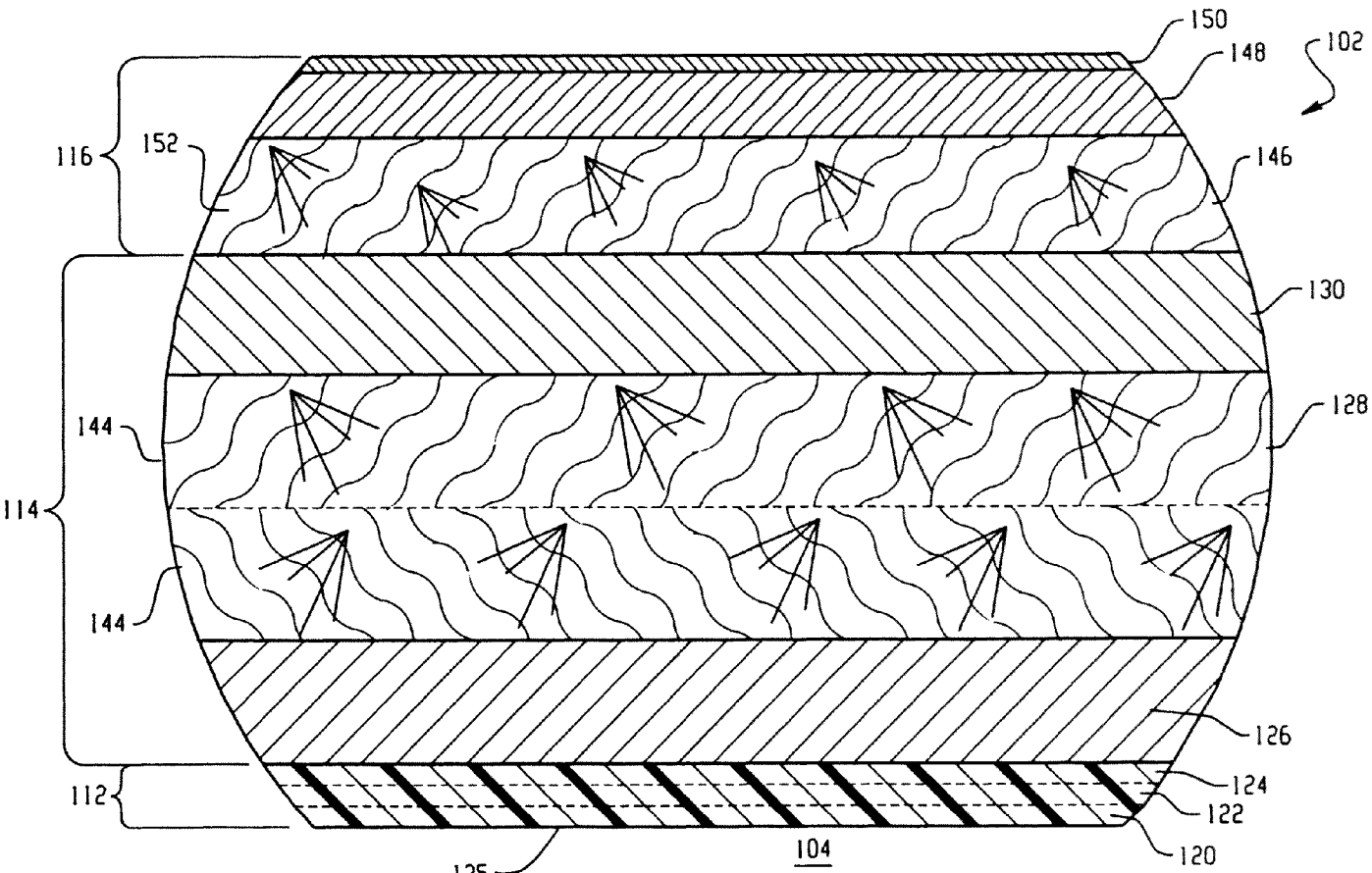
FIG. 2 is a greatly enlarged cross-sectional view of the composite tank wall shown as DETAIL 2 of FIG. 1.

FIG. 2 is an enlarged cross-sectional view of a composite tank wall, such as composite tank wall 102 indicated by DETAIL 2 in FIG. 1, for example. It will be appreciated that FIG. 2 is merely intended to illustrate one exemplary composite tank wall construction, and that other similar constructions can be used without departing from the principles of the present novel concept. Composite tank wall 102 is formed from a plurality of stratified layers, at least some of which include a plurality of lamina or sub-layers. As mentioned above, various ones of the stratified layers are categorized or grouped together as inner composite layer 112, structural composite layer 114 and outer composite layer 116, and will be discussed in detail hereinafter with reference to these composite layers. However, it will be appreciated that such categorization and/or grouping is included merely for convenience of discussion and ease of reading, and is not intended as a limitation.

Inner composite layer or liner 112 is shown in FIG. 2 as including stratified layers 120, 122 and 124. In one exemplary embodiment, stratified layer 120 forms an inside surface 125 of tank cavity 104. As such, it is desirable for stratified layer 120, alone or in combination with stratified layers 122 and 124, to provide the surface properties and/or characteristics compatible with the gas, liquid, solid material or combination thereof that is intended to be stored within tank 100. It is to be understood that any suitable material or combination of materials can be stored within tank 100. However, the subject construction is particularly well suited for use with substantially highly corrosive and/or reactive liquids, such as sulfuric acid, hydrochloric acid and sodium hypochlorite, for example. As such, exemplary materials for stratified layer 120 can include suitable thermoplastics and thermosets, such as organic-inorganic polymers and fluoropolymers, for example. However, it will be appreciated that any suitable material can be used. One specific example of a suitable organic-inorganic polymer is SILOXIRANE, which is available from Advanced Polymer Coatings, LLC of Avon. One specific example of a suitable fluoropolymer is TEFLON, which is available from The DuPont Company of Wilmington, Del.

In one exemplary embodiment of stratified layer 120, the material is from about 0.005 inches to about 0.050 inches in thickness, with a preferred range of from about 0.015 inches to about 0.025 inches in thickness. Applied along stratified layer 120 is stratified layer 122 that includes one or more plies of veil material, which is typically substantially saturated with the material of stratified layer 120.

Stratified layer 124 is formed outwardly of stratified layer 122 and includes sheet material suitable for providing multidirectional strength and/or support to composite layer 112. In one exemplary embodiment, stratified layer 124 includes two plies of fiberglass matting, such as 1½ ounce, short fiber matting, for example. However, it will be appreciated that other suitable materials can be used, such as unidirectional, continuous strand and biaxial materials, for example. It will be appreciated that veil and fiberglass matting materials are commonly available, and materials having the appropriate properties and characteristics, such as thickness and weight, for example, can be selected by the skilled artisan on an application-by-application basis.

Structural composite layer 114 is shown in FIG. 2 as including stratified layers 126, 128 and 130. Preferably, stratified layers 126 and 130 are substantially high-modulus, high-tensile strength layers that include a plurality of lengths of filament material and an adhesive material. Stratified layer 128 is a spacer or core layer disposed between the high-modulus, high-tensile strength layers to form a substantially rigid, sandwich-type construction.

In one exemplary embodiment, layer 126 includes a plurality of lamina (not shown), each formed from a plurality of lengths of filament material. The lengths of filament material are coated with the adhesive material as they are laid, stretched, applied, wound or otherwise extended. The adhesive acts to secure the filaments together and also secures the laminae to one another to form a substantially unitary stratified layer, such as stratified layer 126, for example. Preferably, the lengths of filament material in adjacent layers extend in different directions to increase the strength and stability of the resulting stratified layer.

Figure 3:
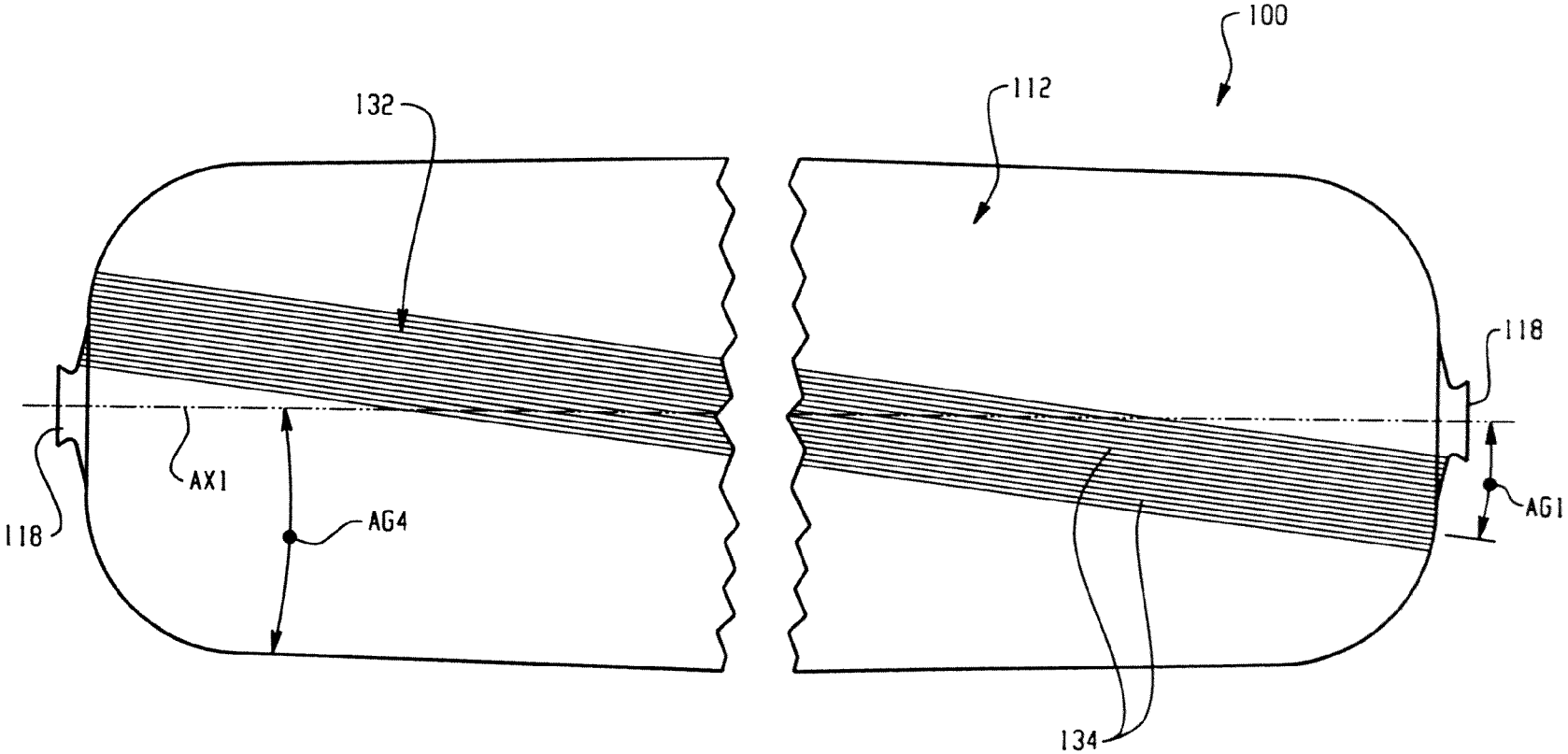
FIG. 3 is a front view illustrating helical polar windings of a length of filament material.
Figure 4:
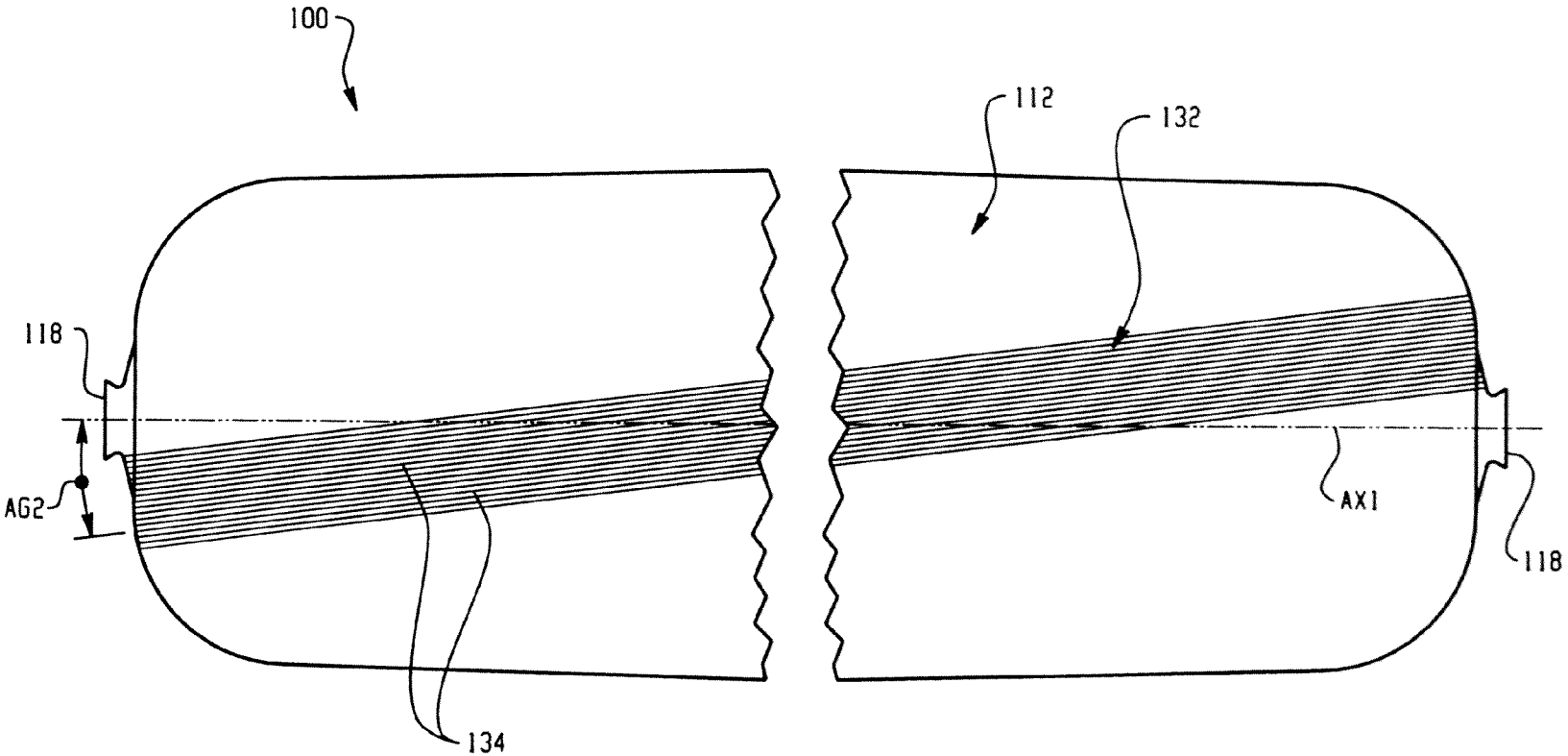
FIG. 4 is a rear view illustrating the helical polar windings in FIG. 3.

An example of such a construction is illustrated by FIGS. 3-6, which shows an inner composite layer or liner 112 having a plurality of lamina formed thereon. In a first winding layer or lamina 132 (FIG. 3), first lengths of substantially high-modulus, high-tensile strength filament material are wound around inner composite layer 112 in a helical polar manner forming a plurality of helical longitudinal windings 134, which are also referred to as polar windings. Lamina 132 also includes an adhesive material (not shown) that coats the filament material to secure the helical windings together and to the exterior of the inner composite layer. Helical windings 134 extend along both sides of the inner composite layer, as shown in FIGS. 3 and 4, between the dome-shaped ends thereof.

The filament material can be wound at any suitable angle AG1 with respect to axis AX1. One example of a suitable range for angle AG1 is from about 0 degrees to about 35 degrees. The filaments in FIG. 3 are shown disposed at an angle of about 15 degrees. As shown in FIG. 4, the filament material extending along the opposite side is disposed at an angle AG2, which is substantially the same in value to angle AG1 but in the opposite direction relative to axis AX1. Each successive winding of the helical polar pattern is incrementally advanced or indexed around the exterior of inner composite layer 112 through substantially all of 360 degrees of rotation of the inner composite layer. Thus, the wound material substantially covers the exterior of the inner composite layer, with the windings overlapping one another to form a full layer of windings extending at angle AG1 and another layer of windings extending at angle AG2. It will be appreciated that such substantially complete coverage is not shown in the drawing figures for the sake of clarity and ease of illustration.

Figure 5:
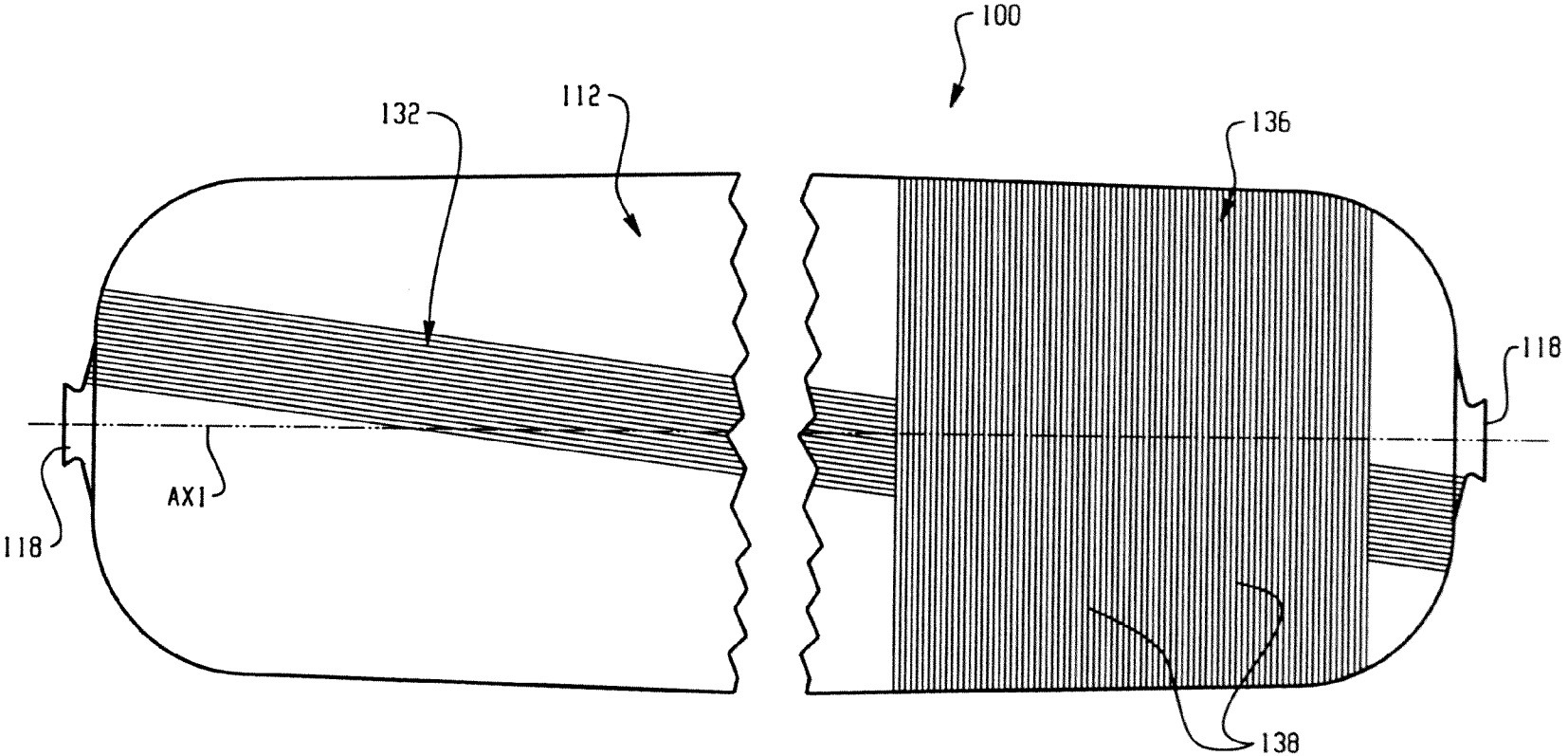
FIG. 5 is a front view illustrating hoop windings of a length of filament material over the helical polar winding in FIGS. 3 and 4.

A second winding layer or lamina 136 is wound along and around inner composite layer 112, as shown in FIG. 5. The second lamina includes second lengths of substantially high-modulus, high-tensile strength filament material. Alternately, however, a transition winding pattern could be used to permit the continued use of the first lengths of filament material used to form helical longitudinal windings 134. The second lengths of filament material are wound in a hoop pattern around the inner composite layer and overtop of first lamina 132, forming a plurality of hoop windings 138. Preferably, the hoop windings extend along and substantially cover the portion of the composite inner layer between the dome-shaped ends. Windings of such a hoop pattern can have lead or winding angle (not numbered) of about zero (0) degrees to about 55 degrees, where the zero degree angle is generally transverse axis AX1. Second lamina 136 also includes an adhesive material (not shown) that is applied along filament material, securing hoop windings 138 together as well as to first lamina 132.

Figure 6:
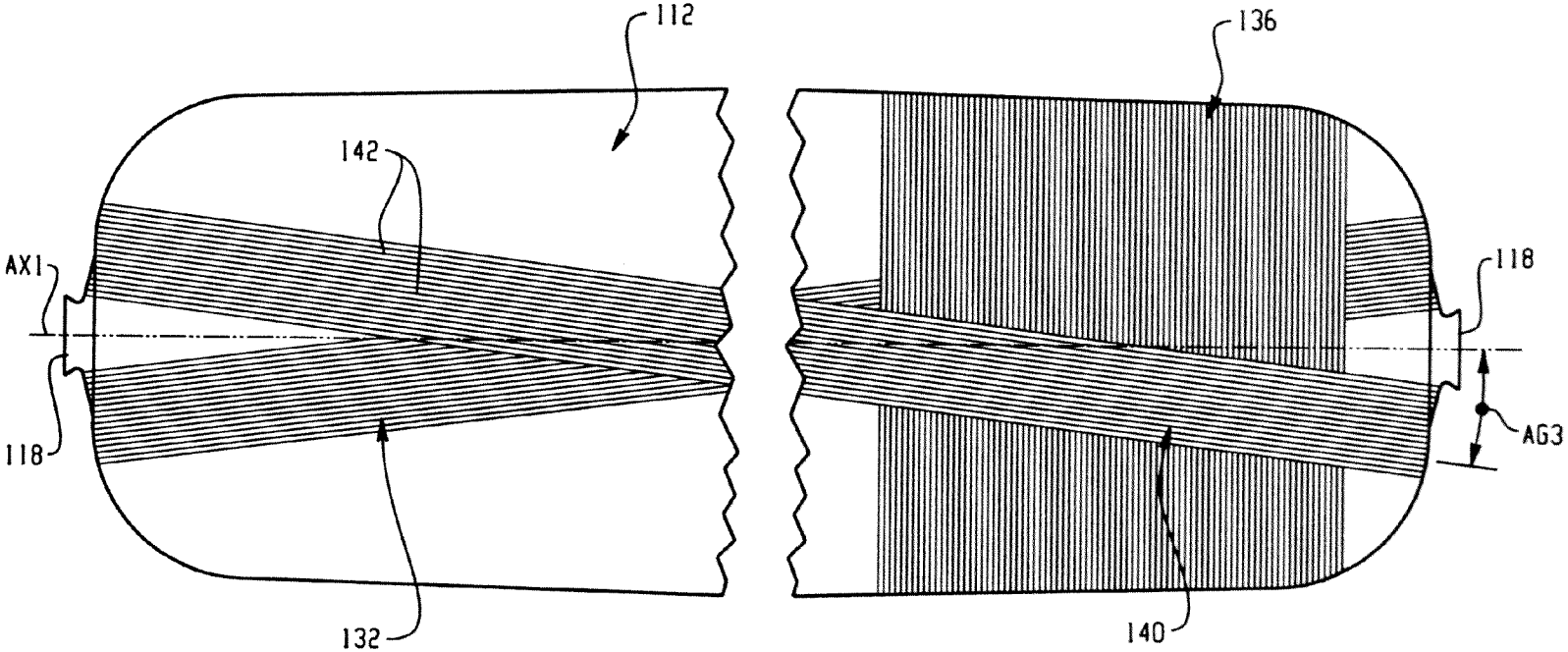
FIG. 6 is a front view illustrating helical polar windings of a length of filament material over the windings in FIGS. 3-5.

A third winding layer or lamina 140 is wound along and around inner composite layer 112, as shown in FIG. 6. Lamina 140 is formed from third lengths of substantially high-modulus, high-tensile strength filament material coated with an adhesive material (not shown). In the alternative, as mentioned above, the second or even the first length of filament material could be used if a suitable transition winding pattern is employed. The filament material is wound in a helical polar pattern with helical longitudinal windings 142 extending along and around the inner composite layer as well as lamina 132 and 136. As discussed above, helical longitudinal windings 142 cover at least a portion of end members 118, and are disposed at an angle AG3 relative to axis AX1. Angle AG3 can be any suitable angle, such as from about 0 degrees to about 35 degrees, for example. In FIG. 6, the helical longitudinal windings are shown as being disposed at an angle of about 15 degrees, similar to helical longitudinal windings 134 of first lamina 132.

Though angles AG1 and AG3 are shown in FIGS. 3 and 6 as being substantially equal, it is to be understood that any suitable angle can be used for the helical windings of any given lamina independent of the angle used for helical windings of other lamina. Additionally, the helical longitudinal windings of lamina 140 are disposed in the same general direction as those of lamina 132. It will be appreciated, however, that the helical longitudinal windings of the lamina could, in the alternative, be disposed in different directions but at the same angle, or even in different directions and at different angles, if suitable for the specific application. Furthermore, the hoop windings of any given lamina can be disposed at any lead or winding angle (not shown) suitable for providing the desired coverage and/or overlap of filament material independent of the lead angle used for other lamina. The pattern of forming lamina having alternating helical longitudinal and hoop windings, as shown in FIG. 3-6 and discussed above, can be continued for any desired number of lamina to form a stratified layer of suitable strength for the intended application.

In one exemplary embodiment, six lamina can be used with the first, third and fifth lamina including helical longitudinal windings and the remaining second, fourth and sixth lamina including hoop windings. In such an exemplary embodiment, the helical longitudinal windings are preferably disposed at an angle of about 15 degrees. Additionally, the hoop windings of the second, fourth and sixth lamina are all wound at substantially similar winding or lead angles of from about zero (0) to 5 degrees, with the zero (0) degree angle being generally transverse the longitudinal axis of the storage tank. Alternately, however, the first and fifth lamina could include helical longitudinal windings that are disposed at substantially similar angles, with the helical longitudinal windings of the third lamina being optionally disposed at a different angle.

The lengths of filament material used in forming the lamina preferably have substantially modulus and substantially high-tensile strength properties, such as a modulus of at least 30 Msi and an ultimate tensile strength of at least 400 ksi, for example. One example of a suitable material includes carbon fiber, which is also commonly referred to as graphite fiber. It will be appreciated that such filament material is typically formed into a bundle that includes many thousands of individual strands of fiber, and can be of any suitable size, dimension or combination of dimensions. For example, the filament material of the first, third and fifth lamina can primarily include a bundle of carbon fibers having a cross-sectional dimension of from about 0.010 inches to about 0.050 inches, and the filament material of the second, fourth and sixth lamina can primarily include a bundle of carbon fibers having a cross-sectional dimension of from about 0.005 inches to about 0.025 inches. Furthermore, the adhesive material can be any suitable adhesive, such as a thermoset polymer or thermoplastic polymer, for example. One example of a suitable thermoset polymer adhesive is epoxy resin, which is commercially available from the Dow Chemical Company of Midland, Mich.

Figure 7A:
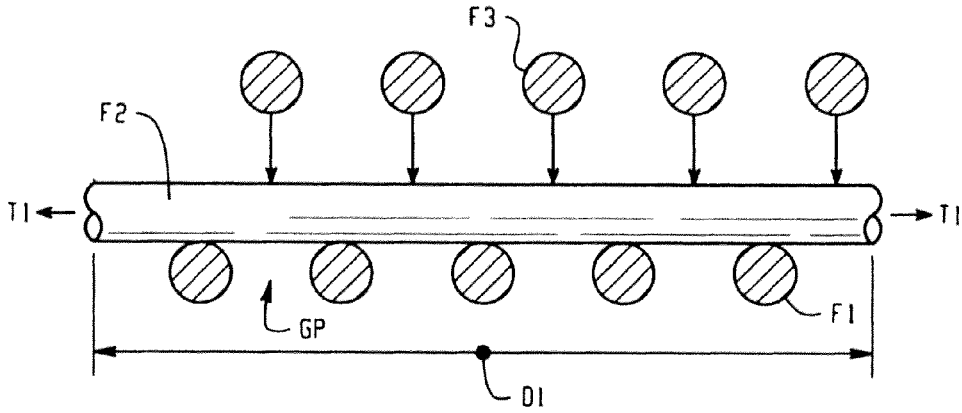
FIGS. 7A and 7B are cross-sectional views of a plurality of windings.
Figure 7B:
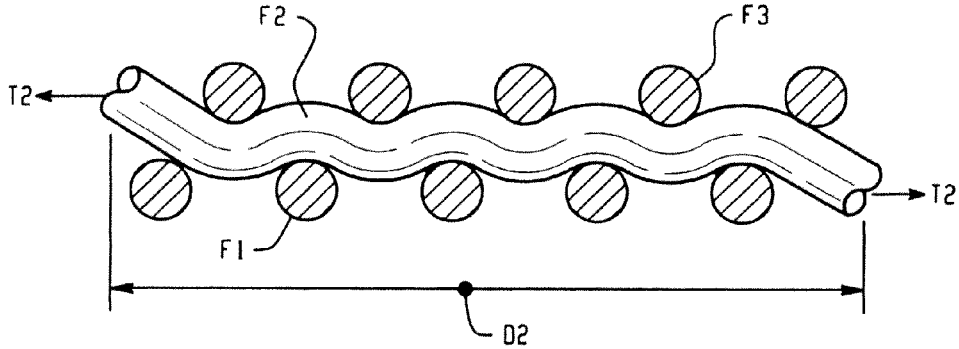

The lengths of filament material used in forming the laminae are preferably wound under tension to pre-stress the individual windings thereof. Any suitable amount of tension can be used, such as from about ½ pound to about 10 pounds, for example. In one exemplary embodiment, tension of from about 3 pounds to about 5 pounds is used. In addition to any amount of pre-stressing due to the actual tension of the filaments being wound, an additional amount of pre-stressing occurs during the winding process to the lamina that are already wound, as is illustrated in FIGS. 7A and 7B. A first plurality of filaments F1 are shown in cross-section as a first lamina in FIG. 7A, with a filament F2 representing a second lamina extending generally transverse the filaments of lamina L1. Due to the tension T1 on filament F2 of the second lamina, the filament extends a distance D1 and does not substantially extend into the gaps GP shown between the filaments. It will be understood that the size of gaps GP are exaggerated for the purposes of illustration. As filaments F3 are applied overtop of filament F2, filaments F3 tend to become aligned with gaps GP, and cause the filaments of the underlying lamina, such as filament F2, for example, to be deflected into the gaps, as shown in FIG. 7B. This deflection causes the length of filament F2 to extend a lesser distance D2 than the original distance D1 in FIG. 7A. This acts to stretch the filament causing a corresponding increased tension T2.

Returning to FIG. 2, stratified layer 128 includes a spacer or core material 144 and an adhesive material (not shown). One of the primary functions of stratified layer 128 is to separate stratified layers 126 and 130. This sandwich-type construction provides substantial strength and rigidity, which will increase as a function of the thickness of stratified layer 128 in a manner well understood by those of skill in the art. As such, it is possible to use a core material that has a relatively low density to minimize the overall weight of the resulting composite structural layer. Preferably, however, core material 144 will also include a sufficiently high shear strength to meet the specifics of the application. Suitable materials include balsa wood, polymeric foam and honeycomb materials.

One exemplary is balsa wood has a density of from about 8 to about 12 pounds per cubic foot. Stratified layer 128 is shown in FIG. 2 as including two plies of core material 144. However, any suitable number of plies can be used. Where multiple plies are used, the same are secured to one another and to stratified layer 126 using adhesive material (not shown), such as those described above in the discussion of stratified layer 126. Core material 144 can have any desired thickness dimension, such as from about ⅛ of an inch to about 1½ inches, for example. Additionally, the appropriate thickness can be determined on an application-by-application basis by one of skill in the art. Furthermore, it will be appreciated that multiple plies of the core material can be used to achieve the desired thickness. For example, two plies of core material 144 are shown as being used in the embodiment in FIG. 2. Additionally, a thinner layer of core material can, in some cases, be used along the domed ends of the tank to offset or otherwise accommodate any additional thickness due to the overlap of filament material caused by forming helical longitudinal windings along the ends.

Stratified layer 130 includes a plurality of winding layers or lamina, such as has been discussed above with regard to stratified layer 126, and in one exemplary embodiment is substantially identical thereto. However, it is to be understood that in other embodiments stratified layers 126 and 130 can have different constructions from those discussed above and/or also constructions that differ from one another.

As mentioned above, the helical longitudinal windings of those laminae having helical polar windings, such as lamina 132 and 140 in FIGS. 3-6, for example, cover at least a portion of end members 118 that are disposed along the dome ends of the tank. In one exemplary embodiment shown in FIG. 8, end member 118 is substantially circular and includes a central body 154 and a radially outwardly extending flange 156 defining an axis AX2. It will be appreciated, however, that any suitable shape or configuration can be used. End member 118 has opposing end surfaces 158 and 160 that, in this exemplary embodiment, are substantially planar. Flange 156 has a frustoconical surface 162 that extends at a suitable angle for providing a transition to and from the tank wall for the filament windings, which are wound along and/or across at least a portion of flange 156. An undercut area 164 is provided adjacent frustoconical surface 162 that extends to surface 158. The undercut area provides additional space for the build-up of filament material as the windings overlap one another. Additionally, one or more features, such as threaded holes 166, for example, that are suitable for attaching a support structure (not shown) to the end member can optionally be included, such as along surface 158, for example.

Outer composite layer 116 is shown in FIG. 2 as including a stratified spacer or core layer 146, a stratified attachment layer 148 and a stratified coating layer 150. Stratified spacer layer 146 includes a spacer or core material 152 and an adhesive material (not shown). Core material 152 can be any suitable material having one of a relatively low density and an energy-absorbing property, such as foam, for example. An additional example of a suitable material for use as core material 152 is balsa wood, which is discussed above as core material 144 of stratified layer 128.

Stratified attachment layer 148 includes a plurality winding layers or lamina that are formed from a plurality of lengths of filament material and an adhesive material (not shown). The plurality of lamina are formed by winding the lengths of material around and along the exterior of core layer 146. In one exemplary embodiment, the filament material of attachment layer 148 has only a relatively high modulus and a relatively high-strength tensile property. Exemplary ranges for such properties include a modulus of from about 1 Msi to about 30 Msi, and an ultimate tensile strength of about 250 ksi or greater, for example. One example of such a suitable material is unidirectional fiberglass, though it is to be understood that other materials can be used. The adhesive coats the filament material and acts to secure the windings of each lamina to one another and to secure the lamina to one another as well.

In one exemplary arrangement, stratified attachment layer includes four winding layers or laminae. The first winding layer or lamina is formed from lengths of fiberglass material, along with an adhesive material (not shown), disposed in a helical polar pattern extending around and along the exterior of core layer 146 forming a plurality of helical longitudinal windings (not shown), such as those discussed above with regard to stratified layers 126 and 130, for example. The second, third and fourth lamina are formed from one or more lengths of fiberglass material disposed overtop of the first lamina in a hoop pattern forming a plurality of hoop windings, again, such as those discussed above. The lengths of fiberglass material are typically formed from many lengths of glass fiber, and can be of any size, dimension or combination of dimensions suitable for the specific of the application. For example, the fiberglass filaments can include bundles of glass fibers having a cross-sectional dimension of from about 0.005 inches to about 0.050 inches. In the exemplary embodiment discussed above, the fiberglass filaments of the first lamina include bundles of glass fibers having a cross-sectional dimension of from about 0.015 inches to about 0.035 inches. In the remaining second, third and fourth lamina, the fiberglass filaments include bundles of glass fibers having a cross-sectional dimension of from about 0.010 inches to about 0.020 inches.

Stratified coating layer 150 is deposited along the exterior of attachment layer 148. The coating layer includes a compound or material (not shown) suitable for providing a specific property or characteristic, such as flame-resistance, for example. Additionally, coating layer 150 is preferably suitable for acting as or, alternatively, receiving an aesthetically appealing coating or cover layer, such as a paint or epoxy coating, for example. Exemplary materials that are suitable for use in forming coating layer 150 include phenolic resin, and flame retardant epoxies, acrylics and vinylesters, for example.

Figure 9:
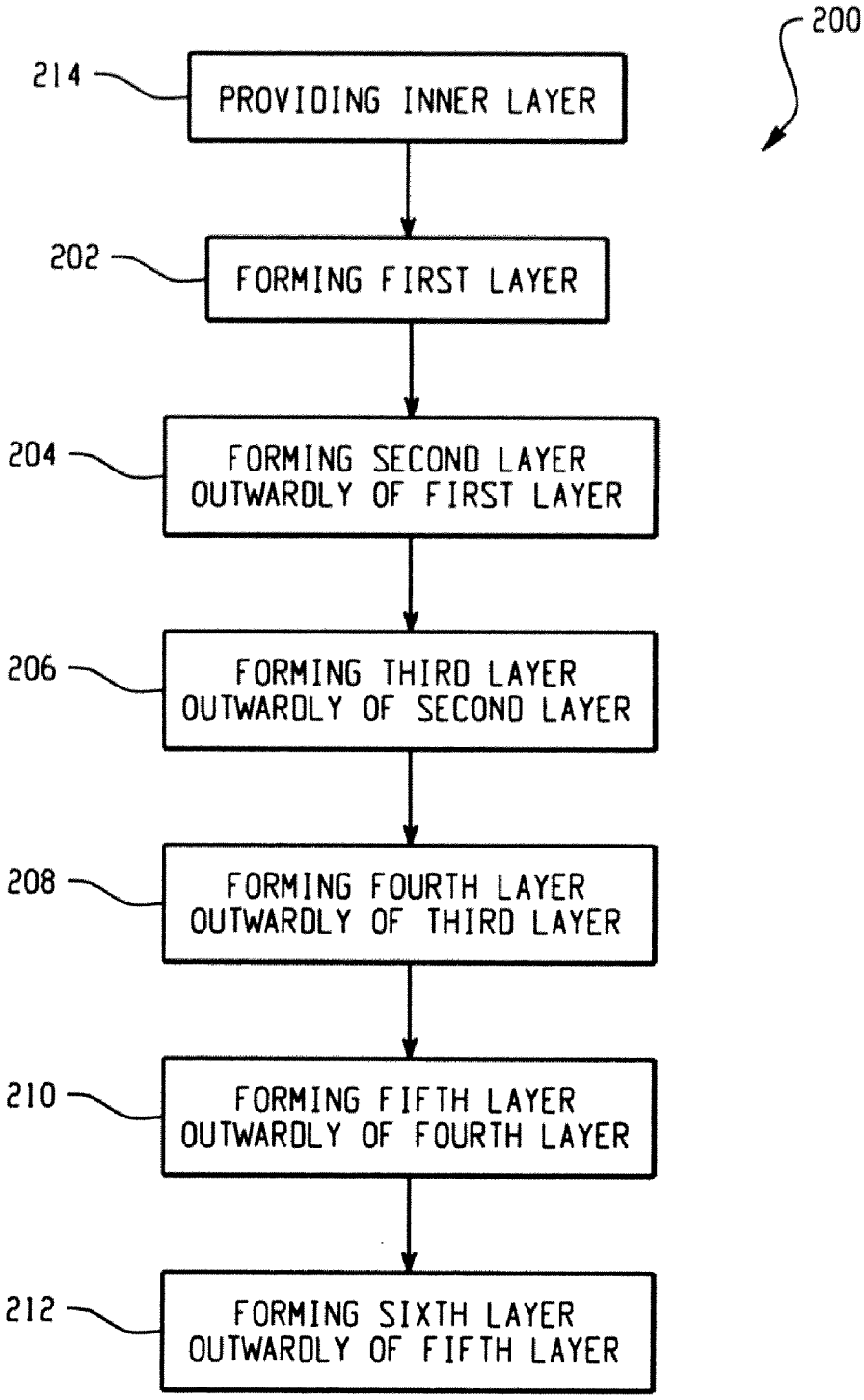
FIG. 9 is a flow chart illustrating steps of one exemplary method of manufacturing a storage tank having a composite tank wall in accordance with the present novel concept.

Turning to FIG. 9, a method 200 of forming a composite storage tank, such as tank 100, for example, includes a step 202 of forming a first layer, such as stratified layer 126, for example. Another step 204 includes forming a second layer, such as stratified layer 128, outwardly of the first layer. Another step 206 includes forming a third layer, such as stratified layer 130, for example, outwardly of the second layer. Still another step 208 includes forming a fourth layer, such as stratified layer 146, outwardly of the third layer. A further step 210 includes forming a fifth layer, such as stratified layer 148, for example, outwardly of the fourth layer. An optional step 212 includes forming a sixth layer, such as stratified layer 150, for example, outwardly of the fifth layer. Another optional step 214 includes providing an inner layer or liner, such as inner composite layer 112, for example, and forming the first layer around the inner layer.

In one exemplary embodiment of method 200, optional step 214 is performed as a first step of providing inner composite layer 112. Step 202 is then performed and includes forming stratified layer 126 along the exterior of inner composite layer 112. In forming the stratified layer, step 202 includes a winding a plurality of lengths of substantially high-modulus, high-tensile strength filament material into a plurality of winding layers or lamina with at least one of the lamina having helical longitudinal windings and with at least another of the lamina having hoop windings. Step 204 is then performed and includes forming stratified layer 128 along the exterior of stratified layer 126. Step 204 includes providing a core material having a low density and securing the material along the outermost lamina of layer 126.

Step 206 is performed after step 204 and includes forming stratified layer 130 along the outer surface of the core material of stratified layer 128. In forming stratified layer 130, step 206 includes winding a plurality of lengths of substantially high-modulus, high-tensile strength filament material into a plurality of winding layers or lamina with at least one of the lamina having helical longitudinal windings and with at least another of the lamina having hoop windings. In one preferred embodiment, layer 130 is formed substantially similar to layer 126. Thereafter, step 208 is performed and includes forming stratified spacer layer 146 along the exterior of stratified layer 130. Step 208 includes providing spacer or core material and securing the core material along the outermost lamina of stratified layer 130.

After completing step 208, step 210 is performed and includes forming stratified attachment layer 148 along the exterior of stratified layer 146. In forming stratified attachment layer 148, step 210 includes winding a plurality of lengths of relatively high-modulus, high-tensile strength filament material into a plurality of winding layers or lamina with at least one of the lamina having helical longitudinal windings and with at least another of the lamina having hoop windings. Step 212 can be thereafter completed and can include applying a stratified coating layer 150 over attachment layer 148 substantially covering the attachment layer. In one preferred embodiment, coating layer 150 includes a phenolic resin having a flame-resistance property or characteristic.

Figure 10:
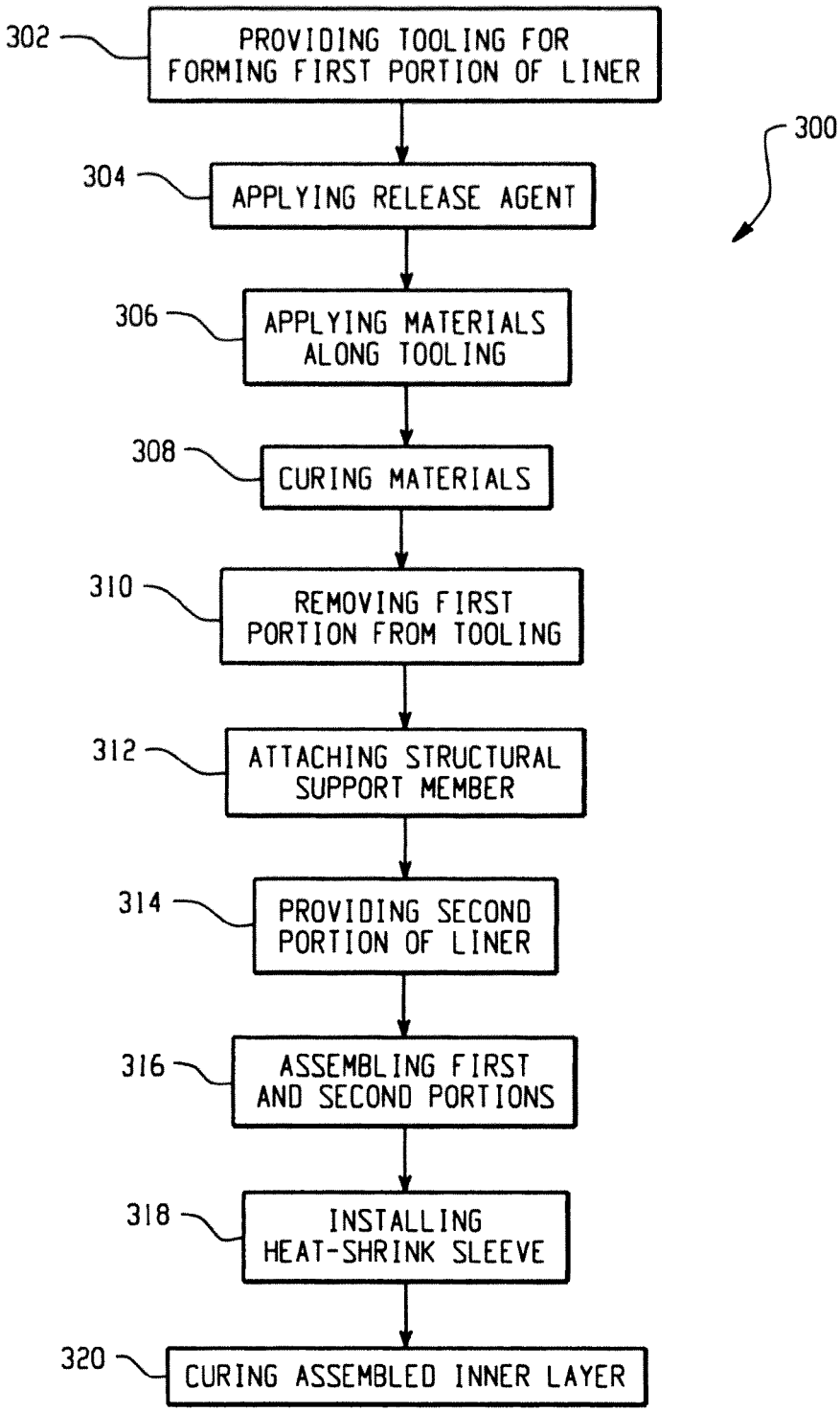
FIG. 10 is a flow chart illustrating steps of one exemplary method of forming a liner of a composite tank wall in accordance with the present novel concept.

Step 214, discussed above, includes providing an inner liner, such as composite inner layer 112, for example. One suitable method of providing an inner layer is illustrated in FIG. 10 as an exemplary method 300 of forming an inner layer. It will be appreciated, however, that other methods and arrangements of method steps can be used in forming alternate embodiments of the composite inner layer. Method 300 includes an initial step 302 of providing tooling for forming a first portion of the inner layer, such as a first section of a two-section construction or central section of a three or more section construction, for example.

An optional step 304 includes applying a release agent to the tooling. It will be appreciated, however, that the use of such a release agent may be desired depending upon the condition of the exterior of the tooling and the materials to be applied therealong. Another step 306 includes applying the materials used to form the inner layer along the tooling to form the first portion. Step 306 can include any suitable application techniques, such as spraying or rolling liquid materials and/or wrapping roll or sheet materials, for example.

As discussed above, composite inner layer 112 can include stratified layers 120, 122 and 124. However, the construction of other embodiments of an inner layer can include other different materials and/or configurations. Once the materials have been applied along the tooling in step 306, another step 308 includes curing the materials in a suitable manner. One example of curing the materials can include heating the materials, such as by using a suitable heating element or lamp, for example. Once the first portion is sufficiently cured, another step 310 includes removing the first portion from the tooling. This can be accomplished in any suitable manner.

Figure 8:
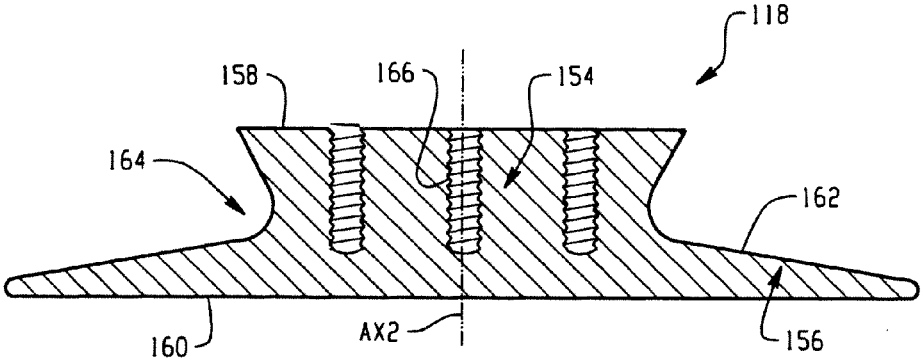
FIG. 8 is a cross-sectional view of the end member in FIG. 1.

One example of tooling suitable for use in forming inner layer 112 includes a substantially cylindrical mandrel that has a collapsible outer tooling surface. Once the material has cured on the outer tooling surface, the mandrel is collapsed. This acts to peel the tooling surface away from the material forming layer 112 and facilitates removal from the mandrel. An optional step 312 includes securing a structural member along the first portion. This can be done to add structural support for handling after removal from the tooling and/or to assist in removal during step 310. One example of such a structural support is end member 118 that is shown in FIGS. 1 and 8 and discussed above with regard thereto.

Another step 314 includes providing a second portion of the liner. This can be accomplished by repeating steps 302-312 or by using another suitable method. Additionally, where the liner is to be formed from three or more segments, the process can be repeated as necessary. Once the two or more portions of the liner have been provided, another step 316 includes assembling the same together to form a substantially unitary body. Typically, the two or more portions will be joined by using a suitable adhesive, sealant or other joining compound. Additionally, an optional step (not shown) of forming a suitable surface or feature along the areas to be joined can also be included. This can be performed after the liner portions have been produced. Alternately, such a feature or surface can be formed into the liner portion during production.

An additional step 318 includes applying an outer sleeve or sock along the joined portions of the liner. One exemplary material for such an outer sleeve is a polyvinyl fluoride film, such as is available from The DuPont Company of Wilmington, Del. under the name TEDLAR, for example. Though, it will be appreciated that other suitable materials can be used. A further step 320 of curing the assembled liner can be performed in any suitable manner, such as by the application of heat, for example.

Figure 11:
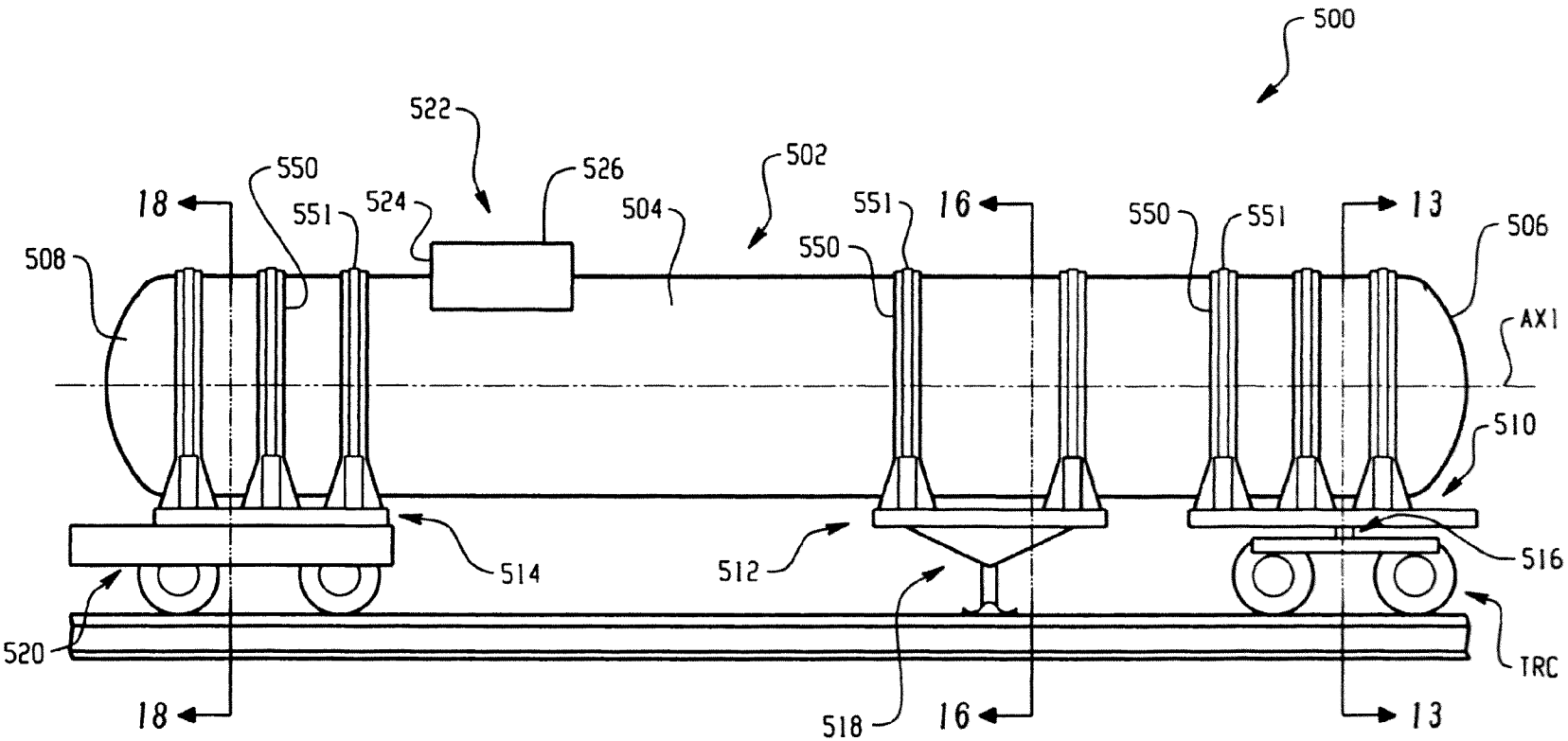
FIG. 11 is a front view of one exemplary embodiment of a composite tank trailer in accordance with the present novel concept.

FIG. 11 illustrates a composite tank trailer 500 that includes a composite storage tank 502 having a central tank portion 504 extending between opposing end portions 506 and 508. For example, central portion 504 of storage tank 502 is shown in FIG. 11 as being generally cylindrical and defining a longitudinal axis AX1 that extends between domed end portions 506 and 508. It will be appreciated, however, that the storage tank can be manufactured in a wide variety of shapes, sizes and/or configurations and that any suitable shape, size and/or configuration can be used.

Storage tank 502 is supported on platform structures 510, 512 and 514, and a pivot connector assembly 516 suitable for engaging a fifth wheel or other hitch or mounting structure of a tractor TRC or other towing vehicle is connected or attached along platform structure 510. A landing gear assembly 518 is connected or attached along platform structure 512 and is suitable for supporting tank 502 when tractor TRC is not in use. A suspension and wheel assembly 520 is supported on platform structure 514 and is operative to support the storage tank during over-the-road transport. It will be appreciated that assemblies 516, 518 and 520 can be attached to the associated platform structures in a suitable manner, and include typical components well known and commonly used by those of skill in the art. Additionally, it will be appreciated that platform structure 512 and landing gear assembly 518 are optional, though such landing gear assemblies are normally used on known trailers.

An access passageway 522 is shown in FIG. 11 and can be optionally included to provide access to the interior of the storage tank. The access passageway includes a side wall 524 secured along central portion 504 of storage tank 502. A top wall 526 extends across an opening or passage (not shown) formed by side wall 524 that provides access to the interior of storage tank 502. Top wall 526 is preferably removable and can include one or more securement devices (not shown) suitable for releasably securing the top wall to, on or along the side wall, such as hinges, latches, locks and/or fasteners, for example.

Figure 12:
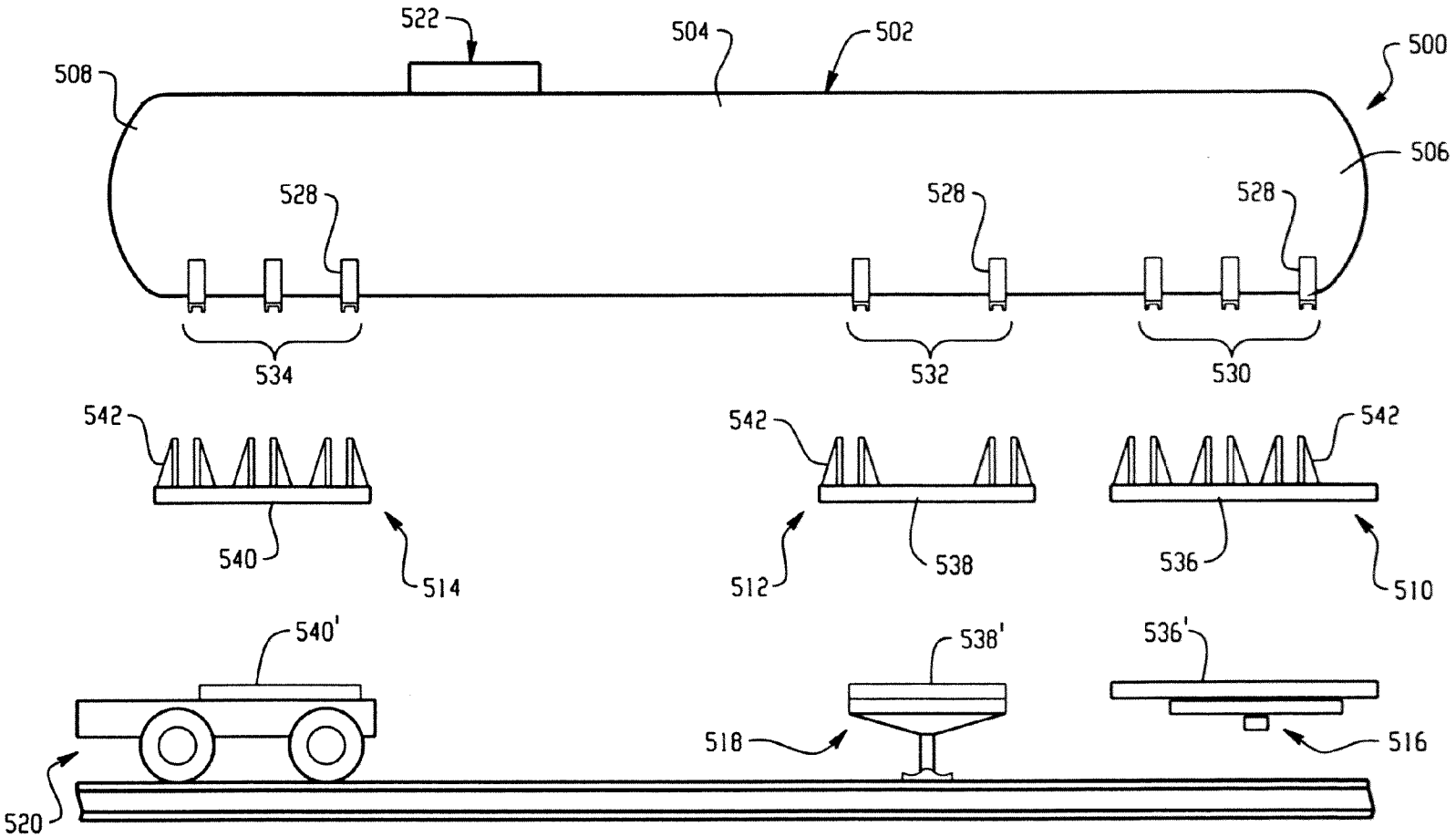
FIG. 12 is an exploded view of the composite tank trailer in FIG. 11.

An exploded view of tank trailer 500 is shown in FIG. 12. The storage tank is supported on platform structures 510-514 using a plurality of saddles or support members 528 disposed along central portion 504 between end portions 506 and 508 of the storage tank. The plurality of saddles are disposed in groups, generally indicated by item numbers 530, 532 and 534, corresponding to platform structures 510, 512 and 514, respectively. Each platform structure includes a platform frame, respectively indicated by item numbers 536, 538 and 540, and a plurality of cradles 542 supported on the platform frames. Preferably, at least one cradle 542 is provided for each saddle 528.

In the exemplary embodiment shown in FIG. 12, the cradles are disposed along the platform frames and are arranged to receive one of the saddles. The cradles disposed along platform frame 536 are positioned to receive the saddles of group 530. Similarly, the cradles disposed along platform frame 538 are arranged to receive the saddles of group 532, and the cradles disposed along platform frame 540 are arranged to receive the saddles of group 534. The platform frames are shown in a second position, indicated by primed (') item numbers 536', 538' and 540', in operative association with assemblies 516, 518 and 520, respectively.

Figure 13:
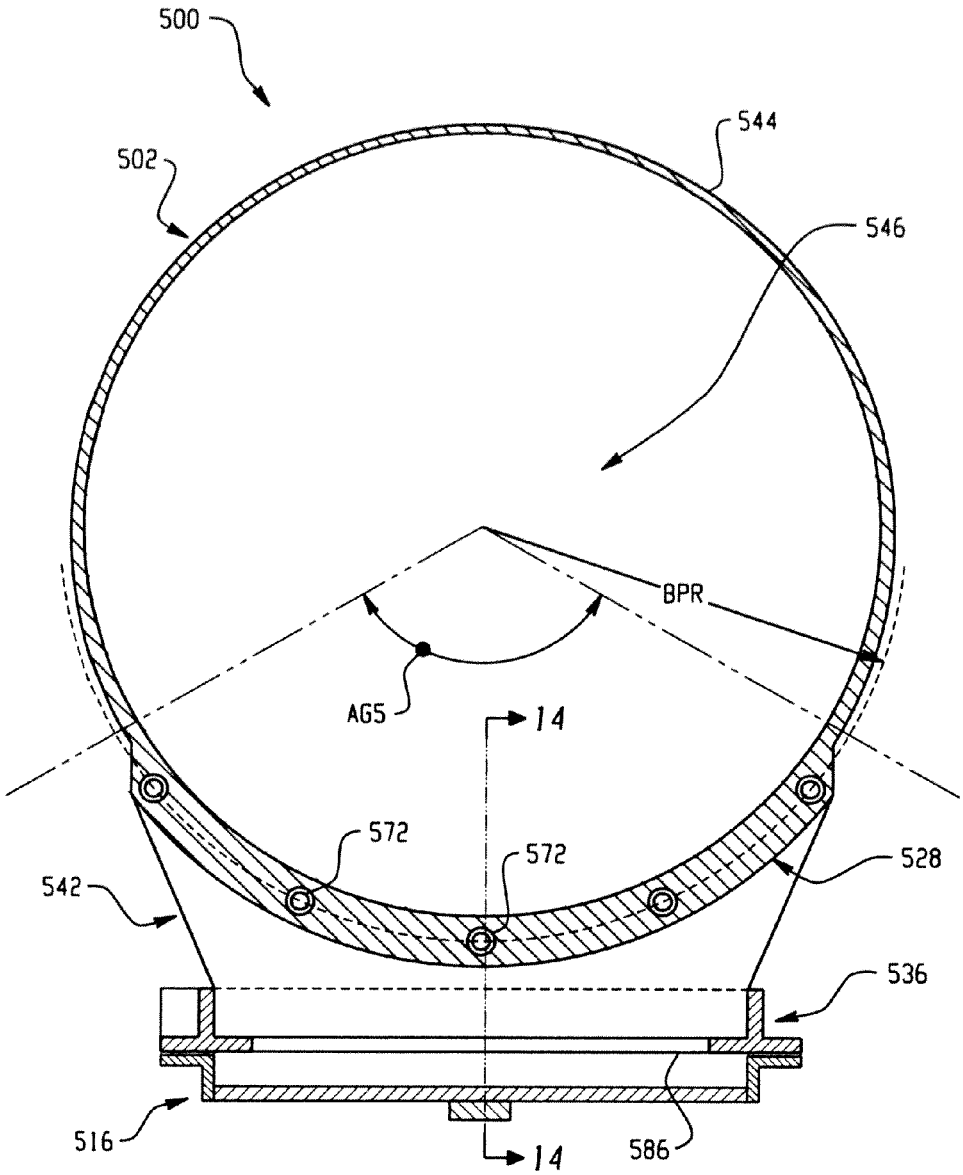
FIG. 13 is a cross-sectional view of the composite tank trailer and support structure in FIG. 11 taken along line 13-13.

FIG. 13 is a cross-sectional view of tank trailer 500 in FIG. 11. Storage tank 502 of tank trailer 500 includes a side wall 544 at least partially defining a tank cavity 546. Side wall 544, along with the end walls (not shown) forming end portions 506 and 508, are preferably formed from a composite or multi-layer wall structure, such as has been discussed above, for example. Saddle 528 is operative to support storage tank 502 on the platform frame associated therewith, which is platform in frame 536 in FIG. 13. Saddle 528 can be secured on or along side wall 544 in any suitable manner.

Figure 14:
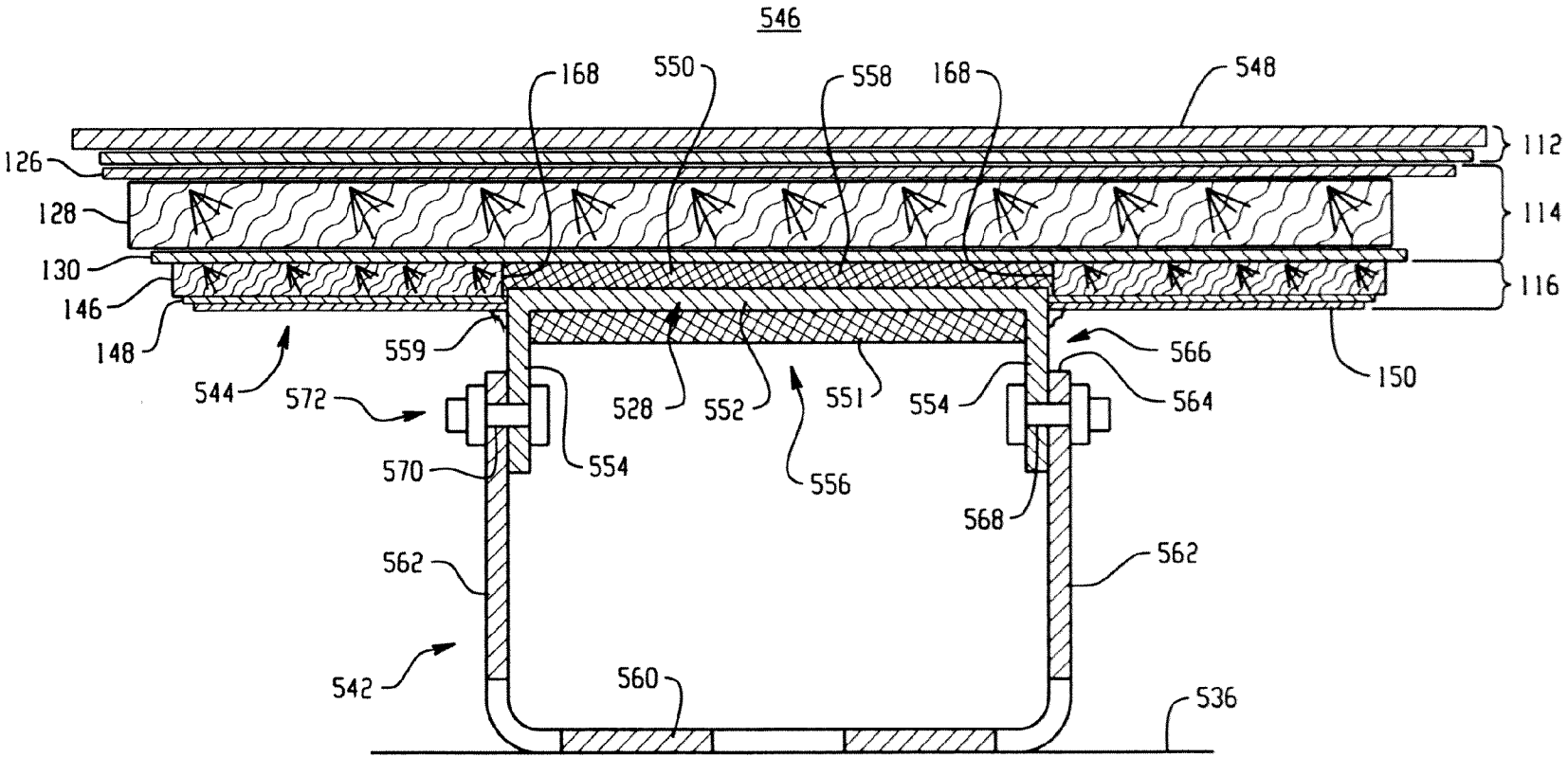
FIG. 14 is a cross-sectional view of the composite tank trailer and platform structure in FIG. 13 taken along line 14-14.

One exemplary embodiment of the saddle being secured along the side wall is shown in FIGS. 13 and 14. In this exemplary embodiment, the storage tank has a wall curvature, such as a circular, ellipsoidal or other suitable uniform or non-uniform curvature. Preferably, saddle 528 includes a curvature that is cooperable with the wall curvature such that the saddle can be disposed along and integrated into side wall 544. Due to the curvatures discussed above, the saddle extends peripherally along the side wall and can do so through any suitable distance or angle, such as an included angle AG5 shown in FIG. 13. One example of a suitable range for included angle AG5 is from about 90 degrees to about 150 degrees, for example. In FIG. 13, angle AG5 is shown as being about 120 degrees.

As shown in FIG. 14, side wall 544 can include a plurality of composite layers, such as layers 112, 114 and 116 discussed above, for example. Composite inner layer or liner 112 includes a tank inside surface 548 at least partially defining tank cavity 546. Composite structural layer 114 is formed outwardly of composite inner layer 112 and includes stratified layers 126, 128 and 130, as discussed above. Additionally, composite outer layer 116 is formed outwardly of composite structural layer 114 from tank cavity 546, and includes stratified layers 146, 148 and 150.

Saddle 528 is disposed inwardly of composite outer layer 116 and extends generally along composite structural layer 114. The saddle can be positioned in abutting engagement with a stratified layer of the composite structural layer, such as stratified layer 130, for example. Alternately, as shown in FIG. 14, an intermediate material 550, such as fiberglass composite, for example, can be secured between stratified layer 130 and the saddle. Additionally, an adhesive material (not shown) can also be included, such as to secure at least one of material 550 and saddle 528 along stratified layer 130, for example.

In the embodiment of tank trailer 500 shown in FIG. 14, saddle 528, which in this case is typical of the plurality of saddles disposed along the tank, is a C-shaped structural member having a web or base wall 552 and a pair of spaced-apart flanges 554 that extend from the base wall forming a channel 556 therebetween. It will be appreciated, however, that any other suitably shaped structural member having a base wall and at least one flange or wall extending from the base wall can be used, such as a T-shaped or L-shaped structural member, for example. Saddle 528 is oriented along the side wall of the tank such that base wall 552 is toward the side wall and flanges 554 extend generally away from the side wall.

Composite outer layer 116 is formed outwardly of composite structural layer 114. Core material 152 of stratified core layer 146 is applied along stratified layer 130 and includes edge walls 168 adjacent saddle 528 forming a void or recess 558 from which the saddle extends. Stratified attachment layer 148 includes a plurality of lamina formed from lengths of filament material wound around and along the exterior of stratified core layer 146, as has been discussed in detail above. Stratified outer or coating layer 150 is applied outwardly of attachment layer 148, again, as has been discussed above. In one exemplary embodiment, layers 146, 148 and 150 terminate adjacent flanges 554 of saddle 528 or other portions thereof. A suitable adhesive, caulk or other sealant material 559 can be applied along and between the saddle and suitable ones of the layers, such as layers 148 and/or 150, for example, to form the desired seal.

Intermediate material 550 (FIGS. 11 and 14) can be disposed between stratified layer 130 and saddle 528 in any suitable manner. In one exemplary embodiment, recess 558 is an annular recess extending circumferentially around the tank. Intermediate material 550 is formed from a plurality of hoop windings of a suitable filament material, such as bundles of glass fiber, for example. One advantage of using an intermediate material is that the same electrically isolates saddle 528, which is typically a metal, such as stainless steel, for example, from the filament material of stratified layer 130, which can be formed from carbon fibers.

Another advantage of forming intermediate material 550 from a plurality of windings is realized where the exterior of composite structural layer 114 is not of a substantially uniform diameter along the length of the tank. Such a situation might occur where composite inner layer 112 has a slight taper, as indicated in FIG. 3 by angle AG4. The taper, though typically only of a small magnitude, could cause an undesirable misalignment between various saddles disposed along the length of the tank. Thus, the ability to wind more or less lamina or layers of hoops to properly align the saddles can be realized. It will be appreciated, however, that other material and/or constructions could also be used to achieve the same result.

A plurality of additional hoop windings 551 (FIGS. 11 and 14) can be used to secure the saddle along intermediate material 550, along with a suitable adhesive material (not shown). Preferably, windings 551 are disposed along channel 556 formed between flanges 554. The windings can be of any suitable filament material, such as bundles of glass fibers, for example, and can be of the same or different material than material 550. A suitable coating (not shown) can optionally be applied along windings 551 to cover the same in a manner similar to stratified coating layer 150, for example. Additionally, it will be appreciated that other structural member can be mounted along the tank in a similar manner, such as an accessory mounting bracket or a pipe hanger, for example.

As shown in FIG. 14, cradle 542 has a generally U-shaped cross section that includes a bottom wall 560 and a pair of spaced-apart cradle walls 562 extending from bottom wall 560 generally away from platform frame 536. Each of cradle walls 562 has a top edge 564 that has a curvature substantially cooperable with the wall curvature of side wall 544 and/or the curvature of saddle 528. Preferably, cradle walls 562 are spaced from one another a suitable distance to receive saddle 528 therebetween. The saddle is positioned within cradle 542 such that flanges 554 overlap cradle walls 562 and a gap 566 is formed between top edge 564 and side wall 544. Preferably, gap 566 is maintained between the top edge and the side wall so that substantially all of the load of tank 502 and its contents is carried through saddles 528 to cradles 542 and the associated platform frame, such as platform frame 536 in FIGS. 13 and 14.

The flanges and cradle walls overlap a sufficient distance to enable the same to be secured together in a suitable manner, such as by welding or using fasteners, for example. In the embodiment shown in FIGS. 13 and 14, for example, a bolt pattern having a radius BPR is formed along each of the cradle walls. Clearance holes 568 and 570 are respectively formed through flanges 554 and cradle walls 562, and are in alignment with one another to receive a bolt and nut assembly 572.

Figure 15:
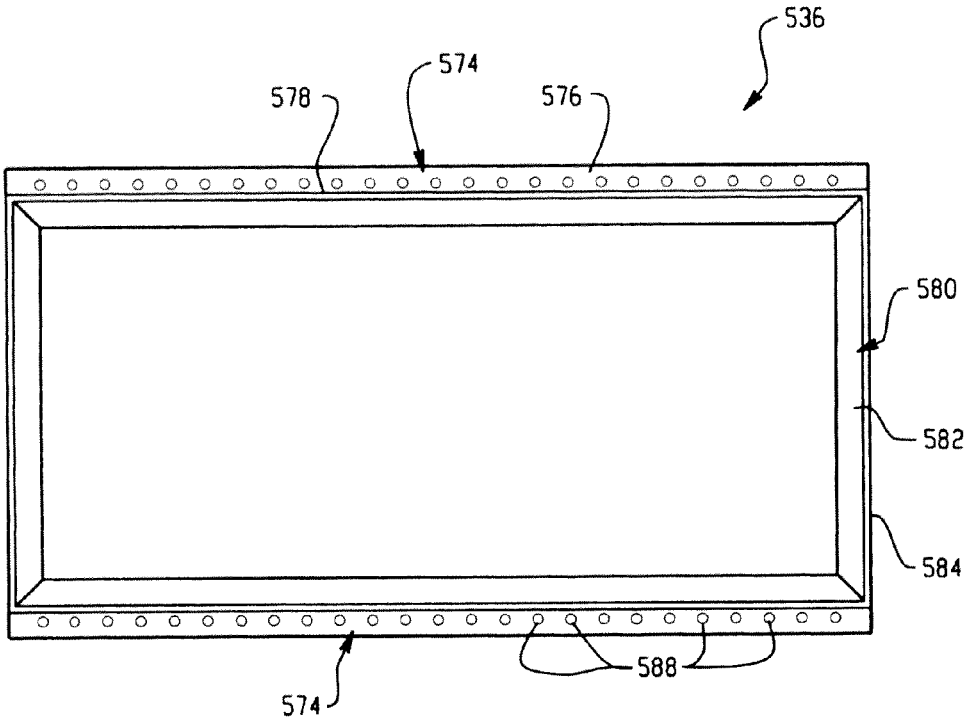
FIG. 15 is a top view of the platform frame shown in FIG. 13.

As shown in FIG. 15, platform frame 536 is formed from a plurality of frame members. The frame members can have any structural shape, length and/or configuration suitable for forming a platform frame. In the embodiment shown in FIGS. 13 and 15, platform frame 536 includes frame members 574 that are T-shaped and include a bottom wall 576 and a flange 578. Platform frame 536 also includes frame members 580 that are L-shaped and have a bottom wall 582 and a flange 584. The frame members can be attached to one another in any suitable manner to form the platform frame, such as by welding or using fasteners, for example. The frame members are arranged such that bottom walls 576 and 582 form a substantially planar bottom surface 586 (FIG. 10) suitable for attachment to and/or along pivot connector assembly 516. A plurality of mounting holes 588 are formed along bottom wall 576 of frame members 574 for receiving fasteners (not shown) to secure the platform frame to the pivot connector assembly. It will be appreciated, however, that any suitable attachment method and/or structure can be used.

Figure 16:
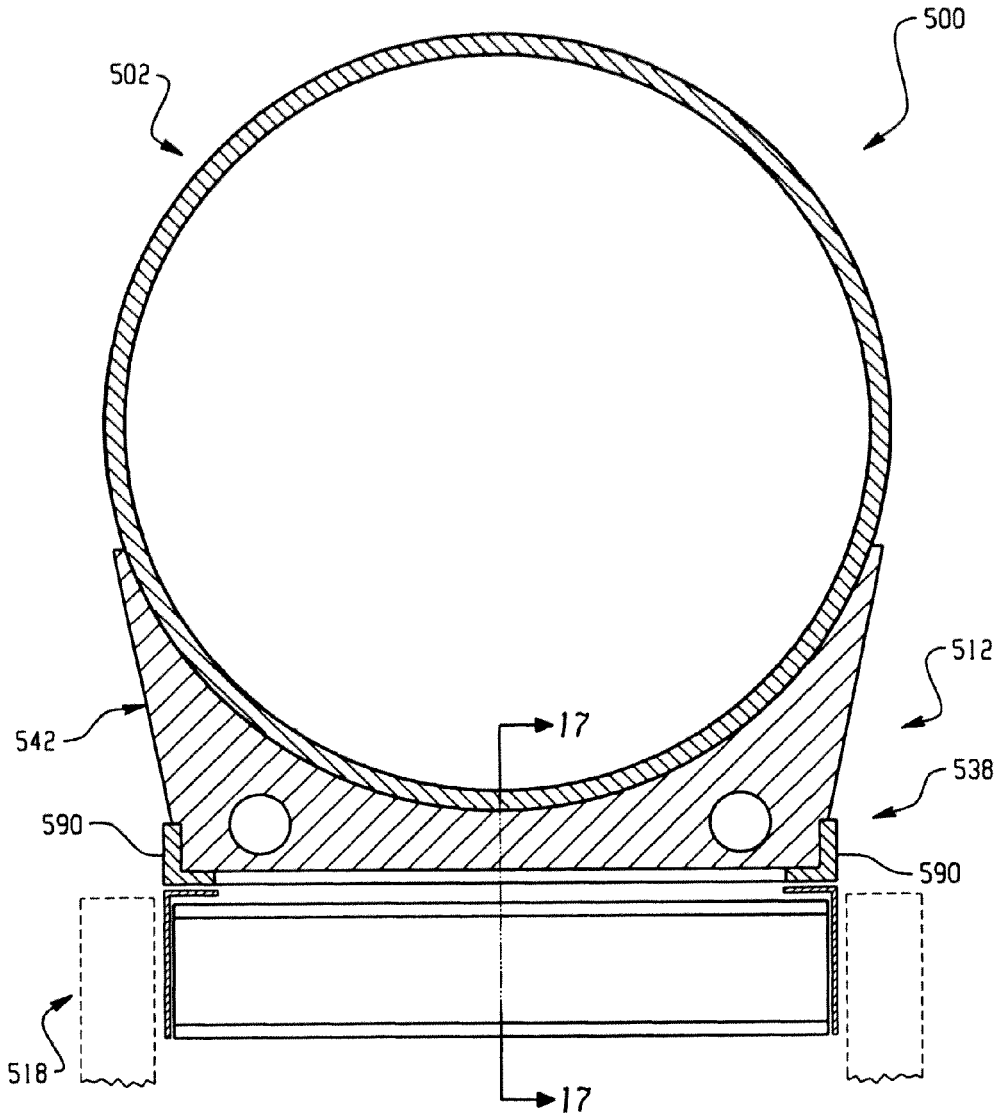
FIG. 16 is a cross-sectional view of the composite tank trailer and platform structure in FIG. 11 taken along line 16-16.
Figure 17:
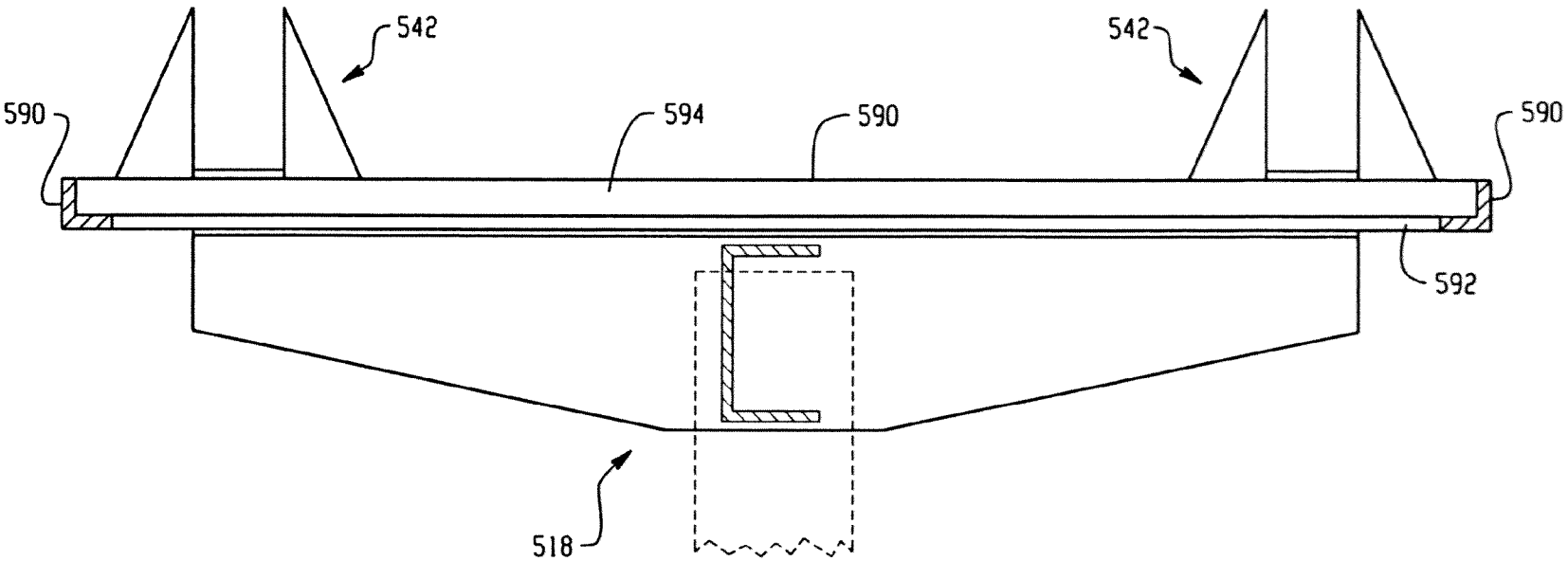
FIG. 17 is a cross-sectional view of the platform structure in FIG. 16 taken along line 17-17.

FIG. 16 is another cross-sectional view of tank trailer 500 in FIG. 11 illustrating storage tank 502 supported on platform structure 512, which is operatively associated with landing gear assembly 518. Platform structure 512 includes cradles 542 (FIGS. 16 and 17) engaging saddle 528 (not shown in FIGS. 16 and 17) to support the storage tank, as discussed above. Platform structure 512 also includes a platform frame 538 on which cradle 542 is supported. Platform frame 538 is formed from a plurality of frame members 590 that are secured to one another in a suitable manner, such as by welding or using fasteners, for example. In FIGS. 16 and 17, frame members 590 are shown as having an L-shaped cross section with a bottom wall 592 and a flange 594 extending from the bottom wall. It will be appreciated, however, that other structural members can be used, such as T-shaped and C-shaped members, for example. Preferably, bottom walls 592 are in substantial alignment and form a planar bottom surface suitable for attachment to landing gear assembly 518.

Figure 18:
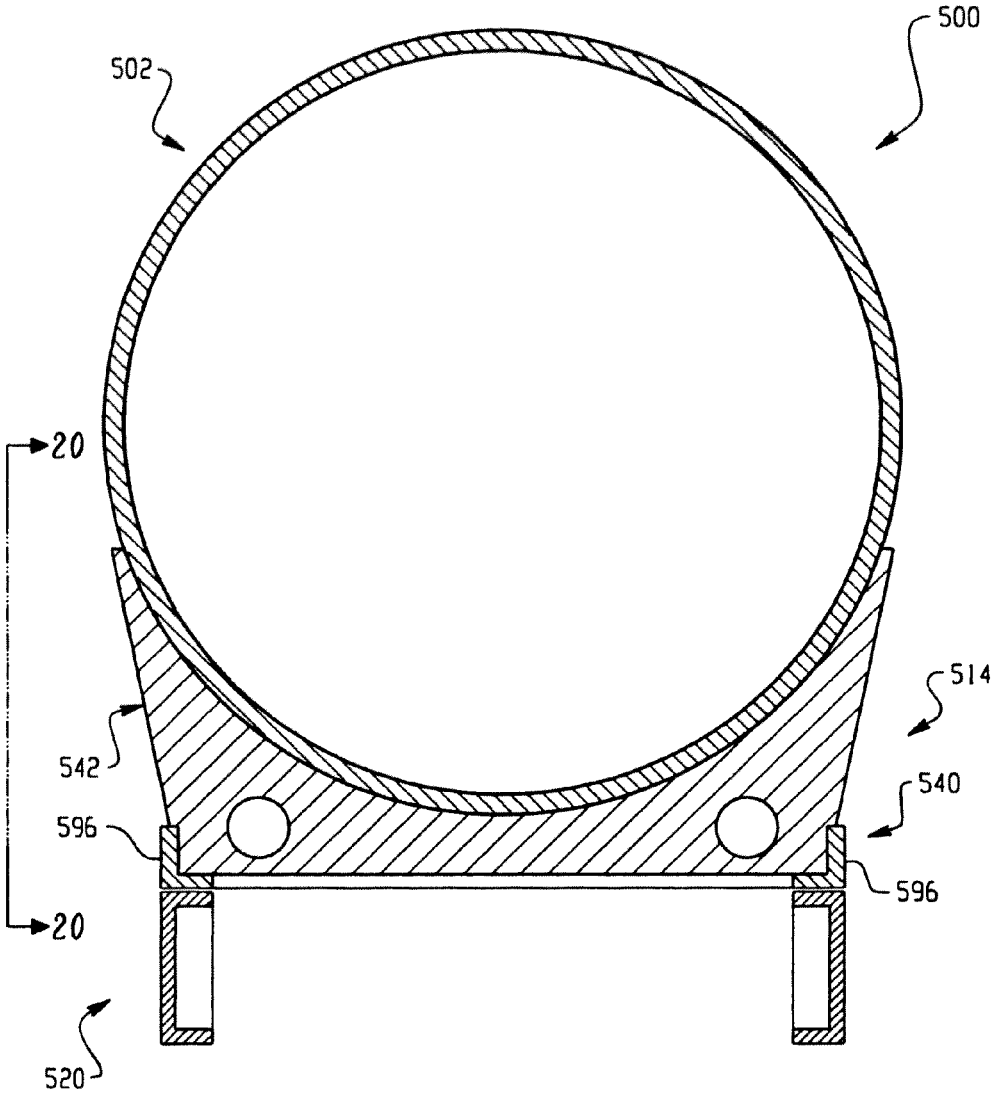
FIG. 18 is a cross-sectional view of the composite tank trailer and platform structure in FIG. 11 taken along line 18-18.
Figure 19:
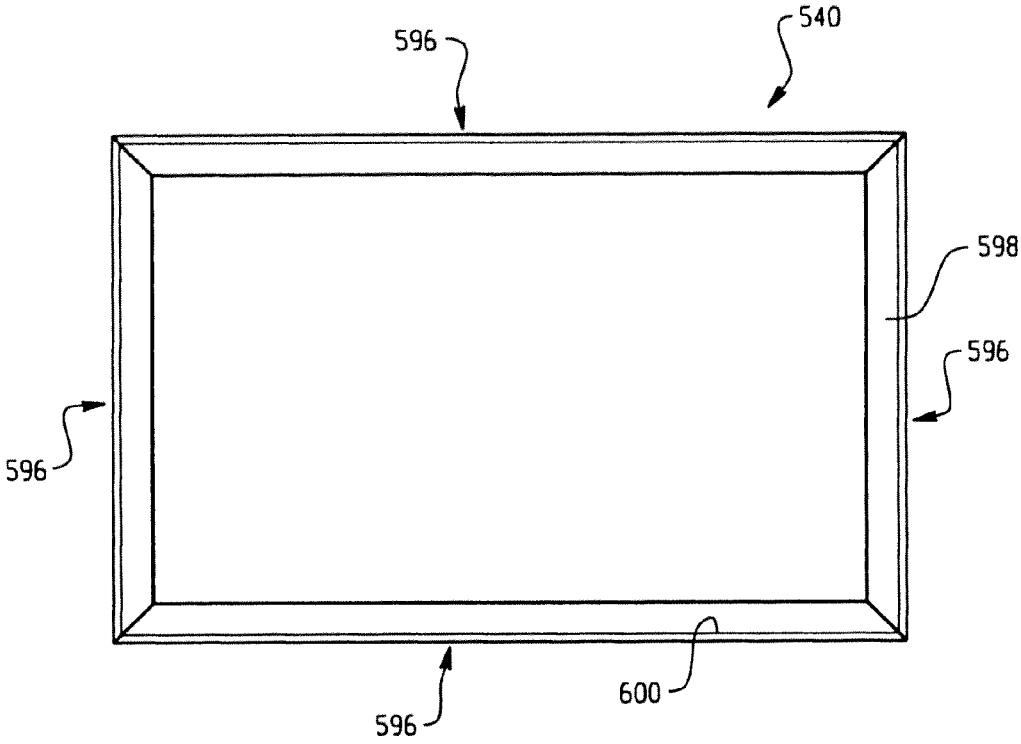
FIG. 19 is a top view of the platform frame in FIG. 18.

FIG. 18 is still another cross sectional view of tank trailer 500 in FIG. 11 and illustrates storage tank 502 supported on platform structure 514, which is operatively associated with suspension and wheel assembly 520. Platform structure 514 includes a cradle 542 engaging a saddle 528 (not shown in FIG. 18) as discussed above to support the storage tank. Platform structure 514 also includes a platform frame 540 on which cradle 542 is supported. As shown in FIGS. 18 and 19, platform frame 540 is formed from a plurality of frame members 596 that are secured to one another in a suitable manner, such as by welding or using fasteners, for example. Frame members 596 are shown as having an L-shaped cross section with a bottom wall 598 and a flange 600 extending from the bottom wall. It will be appreciated, however, that other structural members can be used, such as T-shaped and C-shaped members, for example. Preferably, bottom walls 598 are in substantial alignment and form a planar bottom surface suitable for attachment to suspension and wheel assembly 520.

Figure 20:
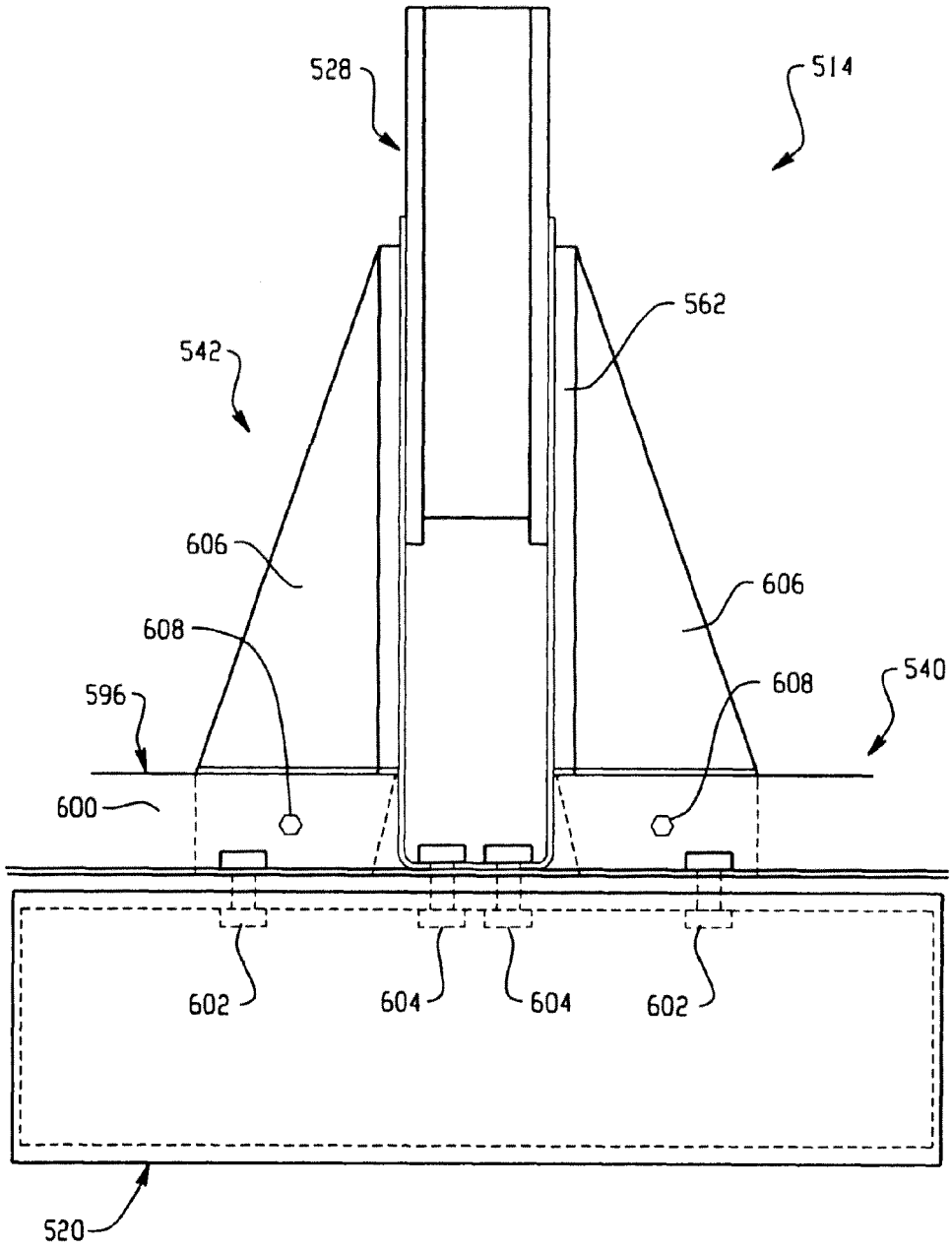
FIG. 20 is a side view of the cradle and platform frame assembly in FIG. 18 taken from line 20-20.

FIG. 20 illustrates platform structure 514 secured to suspension and wheel assembly 520. As discussed above, platform structure 514 includes a platform frame 540 and a plurality of cradles 542 supported thereon. Platform frame 540 can be secured to the structural members of assembly 520 in any suitable manner, such as by using fasteners 602 extending through the bottom wall of frame members 596. Additionally, cradle 542 is secured to platform frame 540 and to the structural members of assembly 520 using fasteners 604, though it will be appreciated that any other suitable securement method or device can be used.

Figure 21:
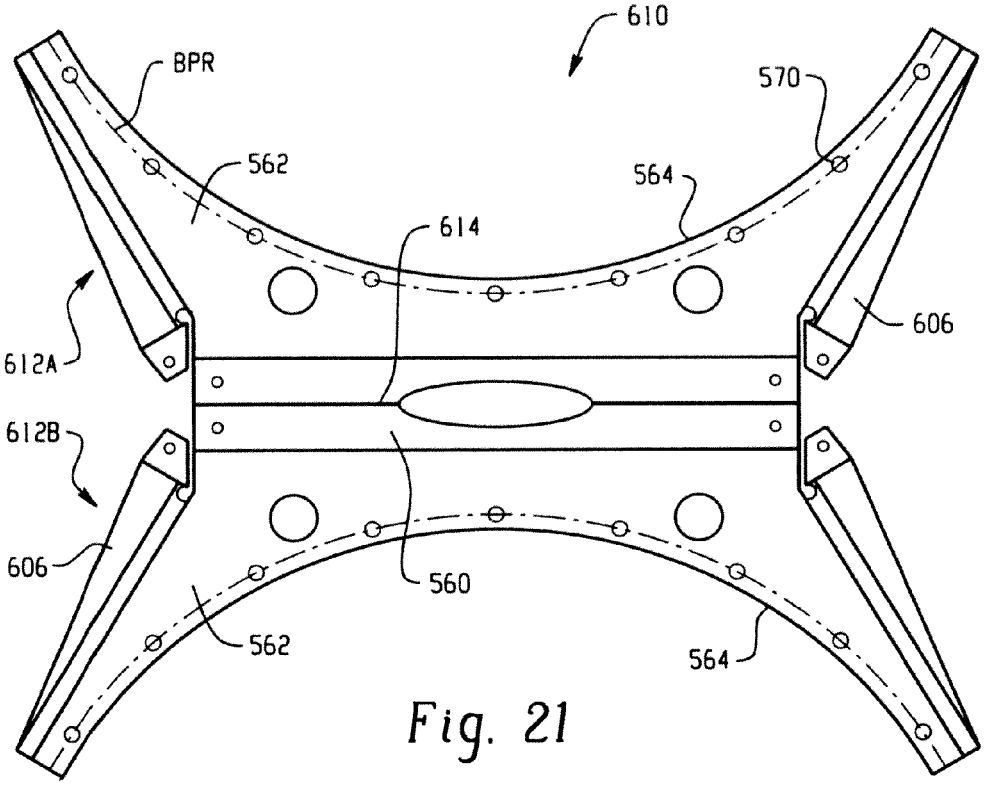
FIG. 21 is a top view of an exemplary embodiment of a sheet metal blank suitable for forming the cradle in FIG. 20.

To provide additional support and/or rigidity to the platform structures, such as platform structure 514, for example, gussets or bolster plates 606 extend from cradle walls 562 toward the associated platform frame. The bolster plates can be attached to the cradle walls in any suitable manner, such as by welding, use of fasteners or by integrally forming the bolster plates with the cradle walls, as shown in FIG. 21, for example. The bolster plates are secured along the flange of the frame members in a suitable manner, such as by welding or by using fasteners 608, for example.

An example of a suitable blank 610 for the manufacture of a cradle, such as cradle 542, for example, having integrally formed bolster plates is shown in FIG. 21. The blank is merely intended to represent one suitable blank for one exemplary cradle embodiment, and is not intended to be in any way limiting. Blank 610 is formed from two portions 612A and 612B that are welded along line 614 to form a unitary blank. The blank portions can be fabricated in any suitable manner known to the skilled artisan, such as laser or torch cutting, shearing, punching, stamping or any other suitable production method. Blank 610 includes portions formable into bottom wall 560, cradle walls 562 and bolster plates 606. Additionally, top edge 564 is formed along cradle walls 562. Once blank 610 is complete, it can be formed, bent or folded into cradle 542 in as will be understood by the skilled artisan.

Figure 22:
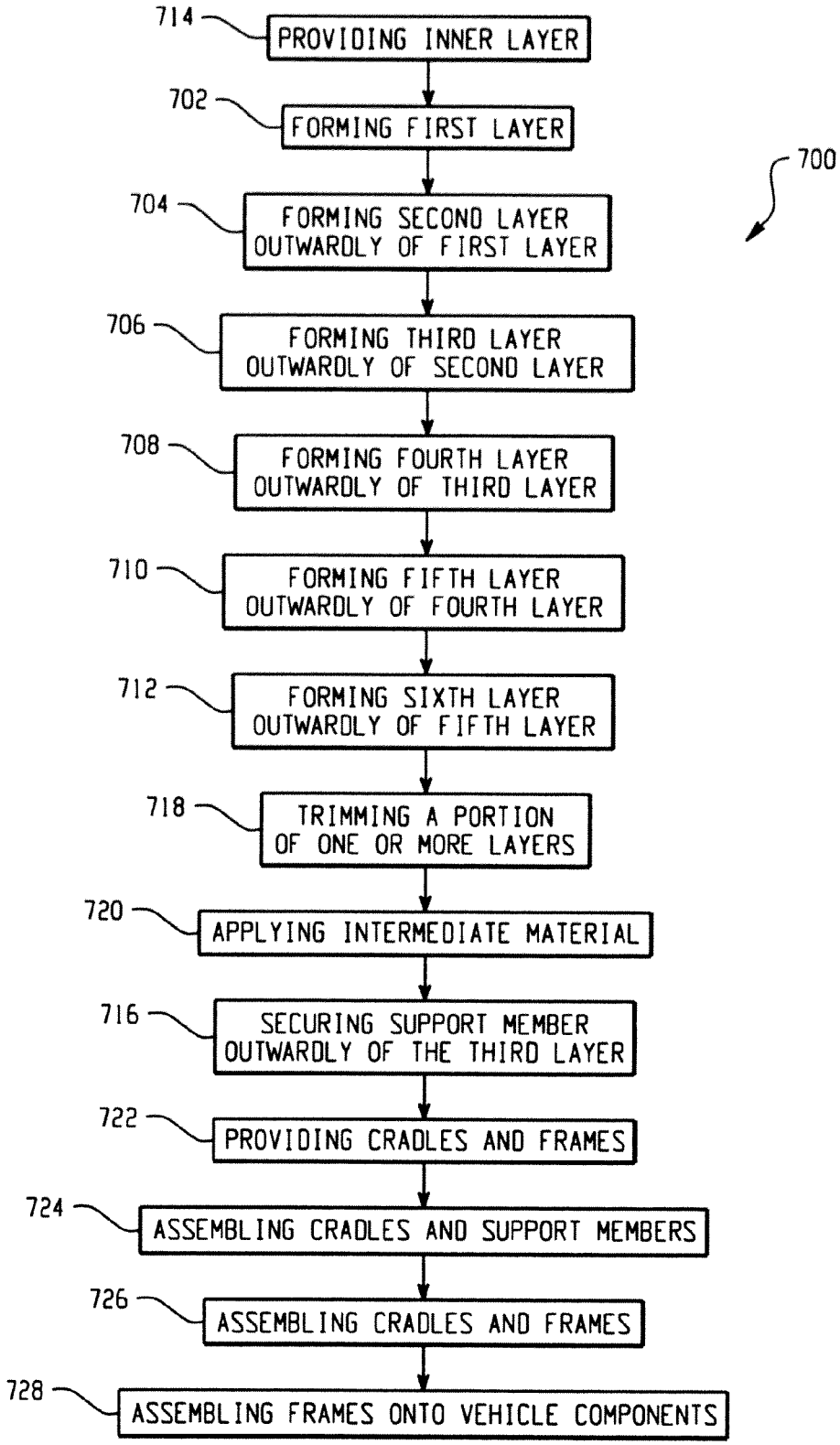
FIG. 22 is a flowchart illustrating steps of a method of manufacturing a composite tank trailer in accordance with the present novel concept.

A method 700 of manufacturing a composite tank trailer is illustrated in FIG. 22 and includes a step 702 of forming a first layer, such as stratified layer 126, for example. Another step 704 includes forming a second layer, such as stratified layer 128, for example, outwardly of the first layer. Still another step 706 includes forming a third layer, such as stratified layer 130, for example, outwardly of the second layer. A further step 708 includes forming a fourth layer, such as stratified layer 146, for example, outwardly of the third layer. Still a further step 710 includes forming a fifth layer, such as stratified layer 148, for example, outwardly of the fourth layer. A optional step 712 includes forming a sixth layer, such as stratified layer 150, for example, outwardly of the fifth layer. Additionally, another optional step 714 includes providing an inner layer or liner. In one preferred embodiment, step 714 is performed prior to performing step 702 and the first layer in step 702 is formed outwardly of the inner layer.

After the tank has been formed, such as after one of steps 710, 712 or 714, for example, another step 716 includes providing a plurality of support members, structural supports or mounting plates, such as saddles 528, for example, and securing the structural supports outwardly of the third layer. The structural support can be secured in abutting engagement with the third layer, or additional optional steps 718 and 720 can be performed. An optional step 718 includes trimming a portion of one or more layers, such as the fourth, fifth and/or sixth layers, for example, to expose the third layer. Optional step 720 includes providing an intermediate material, such as material 550, for example, and applying the intermediate material outwardly of the third layer. Where one or more of optional steps 718 and 720 are included, step 716 is preferably performed thereafter with the structural support or mounting plate secured outwardly of the intermediate material and in abutting engagement therewith.

Once the structural supports have been secured along the tank wall in step 716, another step 722 can be performed which includes providing a plurality of cradles, such as cradles 542, for example, suitable for receiving corresponding the structural supports and providing a plurality of platform frames suitable for receiving the cradles, such as platform frames 536, 538 and 540, for example. Still another step 724 includes assembling the cradles and support members (e.g., saddles) together. A further step 726 includes assembling the cradles onto the platform frames, and still a further step 728 includes assembling the platform frames on to the respective vehicle components.

While the subject novel concept has been described with reference to the foregoing embodiments and considerable emphasis has been placed herein on the structures and structural interrelationships between the component parts of the embodiments disclosed, it will be appreciated that other embodiments can be made and that many changes can be made in the embodiments illustrated and described without departing from the principles of the subject novel concept. Obviously, modifications and alterations will occur to others upon reading and understanding the preceding detailed description. Accordingly, it is to be distinctly understood that the foregoing descriptive matter is to be interpreted merely as illustrative of the present novel concept and not as a limitation. As such, it is intended that the subject novel concept be construed as including all such modifications and alterations insofar as they come within the scope of this disclosure.

The invention claimed is:

1. A method of forming a composite tank trailer, said method comprising steps of:

a) forming a liner having a side wall portion and opposing end wall portions at least partially defining a tank cavity;

b) forming a wall structure outwardly of said liner, said wall structure including a plurality of layers with at least one of said plurality of layers including a length of filament material and an adhesive material;

c) providing a support member and positioning said support member along said wall structure;

d) forming an attachment layer outwardly of said wall structure and at least partially covering said support member to secure said support member along said wall structure;

e) providing a platform structure and securing said platform structure to said support member; and, f) providing a suspension and wheel assembly and securing said assembly on said platform structure.

2. A method according to claim 1, wherein said support member has a base wall and at least one flange projecting from said base wall, and step c) includes a step of orienting said support member such that said base wall is toward said wall structure and said flange extends outwardly generally opposite said wall structure.

3. A method according to claim 2, wherein said attachment layer includes a length of filament material and an adhesive material, and step d) includes steps of coating said length of filament material with said adhesive material and winding said coated filament material along said wall structure to cover at least a portion of said support member and secure said support member along said wall structure.

4. A method according to claim 3, wherein said support member is a generally C-shaped structural member having a central base wall and a pair of space-apart flanges extending from said base wall forming a channel therebetween, and said coated filament material is wound into a plurality of hoops around said wall structure with a portion of said hoops extending along said channel.

5. A method according to claim 1, wherein said wall structure includes a wall curvature, and step c) includes a step of forming said support member to include a curvature cooperable with said wall curvature.

6. A method according to claim 5 further comprising steps of providing a mounting material and positioning said mounting material between said support member and said wall structure prior to step d).

7. A method of forming a composite tank trailer, said method comprising steps of:

a) forming a wall structure having a side wall portion and opposing end wall portions defining a tank cavity and a longitudinal axis, said wall structure including a plurality of layers with at least one layer including a length of filament material and an adhesive material;

b) providing a plurality of support members and positioning said support members spaced longitudinally along said wall structure;

c) forming an attachment layer outwardly of said wall structure and at least partially covering each of said support members to secure said support members along said wall structure;

d) providing a plurality of platform structures and securing each of said platform structures to at least a different one of said support members;

e) providing a pivot pin and a suspension and wheel assembly, and securing each of said pivot pin and suspension and wheel assembly to a different one of said platform structures.

* * * * *